US010546554B2

(12) United States Patent
Xiong et al.

(10) Patent No.: US 10,546,554 B2
(45) Date of Patent: Jan. 28, 2020

(54) SYSTEM AND METHOD FOR ADAPTIVE TONE MAPPING FOR HIGH DYNAMIC RATIO DIGITAL IMAGES

(71) Applicant: Dell Products, LP, Round Rock, TX (US)

(72) Inventors: Dengzhai Xiong, Singapore (SG); Tze Fung Chung, Singapore (SG); Kwok Yeo Tay, Singapore (SG)

(73) Assignee: Dell Products, LP, Round Rock, TX (US)

( * ) Notice: Subject to any disclaimer, the term of this patent is extended or adjusted under 35 U.S.C. 154(b) by 0 days.

(21) Appl. No.: 15/935,910

(22) Filed: Mar. 26, 2018

(65) Prior Publication Data

US 2019/0295504 A1 Sep. 26, 2019

(51) Int. Cl.
*G09G 5/10* (2006.01)

(52) U.S. Cl.
CPC ..... *G09G 5/10* (2013.01); *G09G 2320/0271* (2013.01); *G09G 2320/0626* (2013.01); *G09G 2320/0673* (2013.01)

(58) Field of Classification Search
CPC ..... G09G 5/10; G09G 2320/0271; G09G 2320/0626; G09G 2320/0673; G06T 5/007; G06T 5/008; G06T 5/009; G06T 2207/20208
See application file for complete search history.

(56) References Cited

U.S. PATENT DOCUMENTS

| | | | | |
|---|---|---|---|---|
| 9,076,224 | B1 | 7/2015 | Shah | |
| 2012/0113130 | A1 | 5/2012 | Zhai | |
| 2014/0152694 | A1 | 6/2014 | Narasimha | |
| 2015/0117791 | A1 | 4/2015 | Mertens | |
| 2015/0201222 | A1 | 7/2015 | Mertens | |
| 2015/0269714 | A1* | 9/2015 | Boitard | G06T 5/009 382/274 |
| 2015/0365580 | A1 | 12/2015 | Kunkel | |
| 2016/0125580 | A1* | 5/2016 | He | G06T 15/30 345/590 |
| 2016/0322020 | A1* | 11/2016 | Park | G09G 3/2003 |
| 2017/0034520 | A1* | 2/2017 | Rosewarne | H04N 19/1887 |
| 2017/0064334 | A1* | 3/2017 | Minoo | H04N 19/60 |
| 2017/0084011 | A1* | 3/2017 | Saxena | G06T 5/009 |
| 2017/0103729 | A1* | 4/2017 | Huang | G06T 5/20 |

(Continued)

*Primary Examiner* — Tom V Sheng
(74) *Attorney, Agent, or Firm* — Prol Intellectual Property Law, PLLC; H. Kenneth Prol

(57) ABSTRACT

An information handling system operating an adaptive HDR tone mapping system may comprise a display screen including a plurality of pixels operating at a lower dynamic range of brightness values, a graphics processor executing code instructions to prepare data of an HDR digital image for display at the lower dynamic range, to determine a relative brightness ratio comparing a number of pixels in the data for the image to display at a brightness level below a typical display brightness and at or above the typical display brightness, and to generate a tone map to modify the data of the image if the relative brightness ratio does not meet or exceed a preset threshold such that the pixels are mapped to a maximum brightness of a peaking display brightness level of the display screen, and the display screen displaying the plurality of pixels according to the first adaptive tone map modification.

20 Claims, 8 Drawing Sheets

(56) References Cited

U.S. PATENT DOCUMENTS

| | | | | |
|---|---|---|---|---|
| 2017/0353704 | A1* | 12/2017 | Su | H04N 9/646 |
| 2018/0005357 | A1* | 1/2018 | Lasserre | G06T 5/009 |
| 2018/0007392 | A1* | 1/2018 | Lasserre | H04N 19/98 |
| 2018/0063404 | A1* | 3/2018 | Chen | G06T 5/001 |
| 2018/0082661 | A1* | 3/2018 | Kang | G09G 3/36 |
| 2018/0122058 | A1* | 5/2018 | Kang | G06T 7/136 |
| 2018/0152684 | A1* | 5/2018 | Wozniak | H04N 7/147 |
| 2018/0152686 | A1* | 5/2018 | Wozniak | H04N 7/15 |
| 2018/0220101 | A1* | 8/2018 | Evans | H04N 7/0117 |
| 2018/0232867 | A1* | 8/2018 | Park | G06T 5/00 |
| 2018/0255225 | A1* | 9/2018 | Yu | G09G 5/10 |
| 2018/0330674 | A1* | 11/2018 | Baar | G06T 11/001 |
| 2018/0352257 | A1* | 12/2018 | Leleannec | H04N 19/30 |
| 2019/0052908 | A1* | 2/2019 | Mertens | H04N 19/186 |
| 2019/0058855 | A1* | 2/2019 | Uchimura | G06T 5/009 |
| 2019/0104320 | A1* | 4/2019 | Olivier | H04N 19/36 |

* cited by examiner

| | | | | | | | | | | |
|---|---|---|---|---|---|---|---|---|---|---|
| Lower Bound ($cd/m^2$) | $L_{MIN}=0$ | $L_{MIN}=0$ | $L_{MIN}=0$ | $L_{MIN}=0$ | $L_{MIN}=0$ | $L_{TYP}=400$ | $L_{TYP}=400$ | $L_{TYP}=400$ | $L_{TYP}=400$ | $L_{TYP}=400$ |
| Upper Bound ($cd/m^2$) | $L_{TYP}=400$ | $L_{PEAK}=600$ | $L_{H(1)}=1000$ | $L_{H(2)}=2000$ | $L_{H(N)}=4000$ | $L_{PEAK}=600$ | $L_{H(1)}=1000$ | $L_{H(2)}=2000$ | $L_{H(N)}=4000$ |
| Region | 1 | 2 | 3 | 4 | 5 | 6 | 7 | 8 | 9 |
| Relative Brightness | $RB_{R1}=320$ | $RB_{R2}=340$ | $RB_{R3}=349$ | $RB_{R4}=350$ | $RB_{R5}=350$ | $RB_{R6}=430$ | $RB_{R7}=450$ | $RB_{R8}=450$ | $RB_{R9}=450$ |
| Sub-range Compression Factor | N/A | N/A | N/A | N/A | N/A | N/A | N/A | N/A | N/A |

304 306 308 310 312 314 316 318 320 322 324 326 328 330

Region Luminance Table 302

*FIG. 3*

Output Luminance Table 402

| Input Luminance (cd/m2) | Dynamic Mapping of Key Mapping Points | | Output Luminance (cd/m2) |
|---|---|---|---|
| | Effective Display Range (cd/m2) ($L_{PEAK}$-$L_{TYP}$) | Sub-range Compression Factor | |
| 10000 | 200 | N/A | 600 |
| 4000 | 200 | N/A | 600 |
| 2000 | 200 | N/A | 600 |
| 1000 | 200 | N/A | 600 |
| 600 | 200 | N/A | 600 |
| 400 | 200 | N/A | 400 |
| 0 | 200 | N/A | 0 |
| 418 | 420 | 422 | 424 |

*FIG. 4*

| | | | | | | | | | | |
|---|---|---|---|---|---|---|---|---|---|---|
| Lower Bound ($cd/m^2$) | $L_{MIN}=0$ | $L_{MIN}=0$ | $L_{MIN}=0$ | $L_{MIN}=0$ | $L_{MIN}=0$ | $L_{TYP}=400$ | $L_{TYP}=400$ | $L_{TYP}=400$ | $L_{TYP}=400$ | $L_{TYP}=400$ |
| Upper Bound ($cd/m^2$) | $L_{TYP}=400$ | $L_{PEAK}=600$ | $L_{H(1)}=1000$ | $L_{H(2)}=2000$ | $L_{H(N)}=4000$ | $L_{PEAK}=600$ | $L_{H(1)}=1000$ | $L_{H(2)}=2000$ | $L_{H(N)}=4000$ |
| Region | 1 | 2 | 3 | 4 | 5 | 6 | 7 | 8 | 9 |
| Relative Brightness | $RB_{R1}=320$ | $RB_{R2}=400$ | $RB_{R3}=500$ | $RB_{R4}=600$ | $RB_{R5}=600$ | $RB_{R6}=500$ | $RB_{R7}=800$ | $RB_{R8}=1500$ | $RB_{R9}=2000$ |
| Sub-range Compression Factor | N/A | N/A | N/A | N/A | N/A | $SRCF_1=0.0625$ | $SRCF_2=0.1875$ | $SRCF_3=0.4375$ | $SRCF_4=0.3125$ |

504 506 508 510 512 514 516 518 520 522 524 526 528 530

Region Luminance Table 502

*FIG. 5*

Output Luminance Table 602

| Input Luminance ($cd/m^2$) | Dynamic Mapping of Key Mapping Points | | Output Luminance ($cd/m^2$) |
|---|---|---|---|
| | Effective Display Range ($cd/m^2$) ($L_{PEAK}$-$L_{TYP}$) | Sub-range Compression Factor | |
| 604 10000 | 620 200 | 622 0 | 624 600 |
| 606 4000 | 200 | 0.3125 | 600 |
| 608 2000 | 200 | 0.4375 | 537.5 |
| 610 1000 | 200 | 0.1875 | 450 |
| 612 600 | 200 | 0.0625 | 412.5 |
| 614 400 | 200 | N/A | 400 |
| 616 0 | 200 | N/A | 0 |

618

*FIG. 6*

SYSTEM AND METHOD FOR ADAPTIVE TONE MAPPING FOR HIGH DYNAMIC RATIO DIGITAL IMAGES

FIELD OF THE DISCLOSURE

The present disclosure generally relates to information handling systems, and more particularly relates to processing of high dynamic ratio (HDR) digital images for display on standard dynamic ratio (SDR) video displays or other displays with a lower dynamic range than the HDR digital image data. Embodiments of the present disclosure may adaptively compress HDR digital images according to an optimal compression method based on analysis of one or more received HDR digital images.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

For purposes of this disclosure, an information handling system may include any instrumentality or aggregate of instrumentalities operable to compute, determine, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components. Further, the information handling system may include graphics processing capabilities including processing of high dynamic ratio (HDR) digital images for display on standard dynamic ratio SDR video displays or other displays with lower dynamic range than HDR digital image data.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which:

FIG. 3 is a block diagram illustrating a region luminance table according to a first embodiment of the present disclosure;

FIG. 4 is a block diagram illustrating an output luminance table according to a first embodiment of the present disclosure;

FIG. 5 is a block diagram illustrating a region luminance table according to a second embodiment of the present disclosure;

FIG. 6 is a block diagram illustrating an output luminance table according to a second embodiment of the present disclosure;

The use of the same reference symbols in different drawings may indicate similar or identical items.

DETAILED DESCRIPTION OF THE DRAWINGS

Figure 1:
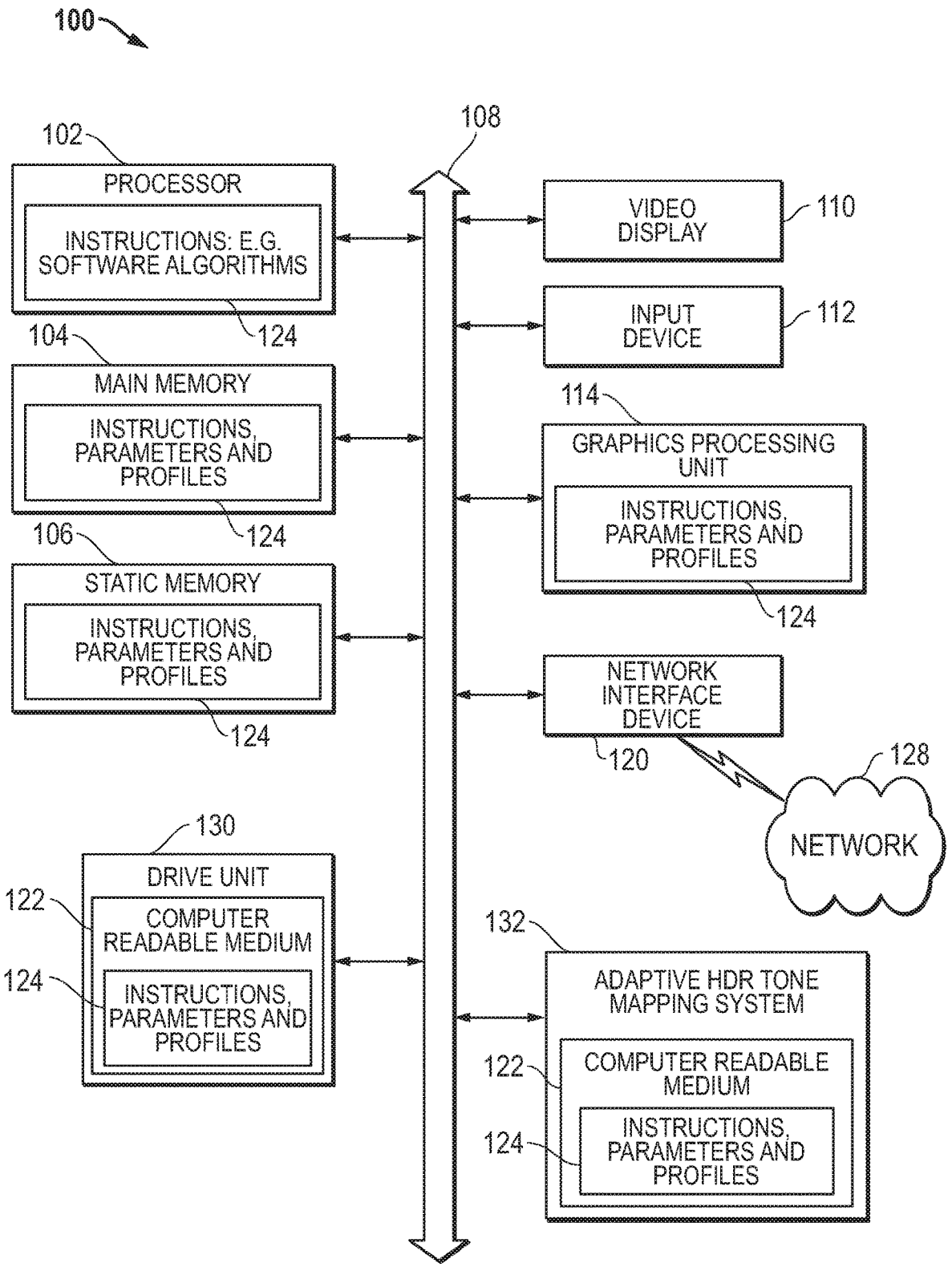
FIG. 1 illustrates a generalized embodiment of information handling system according to an embodiment of the present disclosure.

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

An increasing number of display devices are being designed to support high dynamic range (HDR) video inputs although they may nonetheless be standard dynamic range (SDR) devices themselves. Many software applications and video streaming content provide HDR video data for use with SDR video display devices or other display devices with lower dynamic range of supported of brightness or luminance values than the received HDR digital video data, however such data may sometimes be displayed on SDR devices. Although SDR video display devices are referred to throughout the current disclosure, it is understood that SDR video display devices may also include video display devices with a lower supported dynamic range of luminance values than called for in received HDR digital video image data for display on those devices. Conversion to SDR video display ranges or other lower dynamic ranges is required in some circumstances with limited degradation in quality of the displayed output. The present disclosure relates to various embodiments of achieving conversion for purposes of presenting HDR video inputs on SDR video display systems or other lower dynamic range display system. The most popular standard adopted to define HDR inputs is the HDR-10 standard which uses a Perceptual Quantizer defined by the standard SMPTE 2084 of the Society of Motion Picture and Television Engineers (SMPTE) as its electro-optical transfer function (EOTF). The defined luminance range according the HDR-10 standard is up to 10,000 candelas per meters squared (cd/m$^2$), which is much greater than the operating luminance range of up to 400 cd/m$^2$ or 600 cd/m$^2$ of most current standard dynamic range displays. In order to render the HDR input received in HDR digital images on SDR display systems or other lower dynamic range display systems, a tone mapping system is needed to translate luminance values in the HDR input that exceed the operational range of an SDR or other lower range display into the operational range of the SDR or other lower dynamic range display. However, the HDR-10 standard does not outline how such a translation should be done.

Tone mapping from one luminance range to another may have significant impact on the perception of the rendered content, especially when the operational luminance range of the display differs greatly from the luminance range of the received HDR input. Clipping of the luminance values exceeding the operational luminance range of the display may be one option. Simple clipping of higher operational luminance range values may sacrifice important details meant to be rendered at the higher luminance values, thus distorting the image. This may occur in situations in which a large proportion of the contents of the digital image are meant to be rendered at the higher luminance values. In such situations, it may be optimal to linearly compress the luminance values that exceed the operational luminance values of the display into the operational luminance values, while preserving the relative contrast between the higher-level luminance values. In such a way, the image may not be distorted, or may be distorted less than a compression method involving clipping all luminance values exceeding the operational luminance range of the display.

In other situations in which a relatively small proportion of the contents of the digital image are meant to be rendered at the higher luminance values, linearly compressing the luminance values that exceed the operational luminance values of the display into the operational luminance values may cause a loss in contrast between luminance values within the operational luminance range of the display, causing a different distortion problem of the digital image with translation to SDR. In such a scenario, it may be optimal to clip or cap the input luminance values exceeding the operational luminance value of the display at the maximum or peaking display luminance value to maintain contrast aspects. In such an example embodiment, the image may not have contrast distorted, or may be distorted less than a linear compression method. Some loss of highlighting or other high brightness detail in the image may be lost by capping or clipping, but with fewer values exceeding the operational luminance values supported by the lower dynamic range display device the effect may be minimal. In existing tone mapping methods, the method of compression used is preset prior to receipt of the HDR digital image. Linear compression or clipping is conducted without consideration of the distribution of luminance of the HDR digital image to be displayed. This likely results in either over compression or unnecessary clipping of luminance values and ultimately in distortion of some set of the images received whichever compression is used.

A method is needed to determine between which of the above methods should be employed to compress HDR digital image data. Selecting the better compression method for the image enables it to be displayed without distortion on an SDR video display or other lower dynamic range video display having a maximum or peaking display luminance below the maximum input luminance of the HDR digital image. Embodiments of the present disclosure address such an issue by comparing the portion of the HDR digital image dedicated to displaying the luminance values that fall outside an effective range of the SDR video display to the portion of the HDR image dedicated to displaying luminance values inside the effective range of the SDR video display. The effective range of the SDR video display may include all luminance values at or below the typical luminance for the SDR video display.

In embodiments of the present disclosure, a measure of relative brightness for the luminance values at or below the typical luminance value of the display may provide an estimate of the portion of the HDR digital image that is dedicated to the display of luminance values inside the operable range of the SDR video. The relative brightness for the luminance values at or below the typical luminance value in embodiments may be equivalent to the total number of pixels associated with luminance values at or below the typical luminance value for the SDR display according to the HDR digital image data, multiplied by the average of all luminance values associated with each of those pixels according to the HDR digital image data. Similarly, in embodiments, a measure of relative brightness for the luminance values exceeding the typical luminance value of the display may provide an estimate of the portion of the HDR digital image that is dedicated to the display of luminance values outside the operable range of the SDR video, which may be equivalent to the total number of pixels associated with luminance values exceeding the typical luminance value for the SDR display according to the HDR digital image data, multiplied by the average of all luminance values associated with each of those pixels according to the HDR digital image data. A comparison of the portion of the HDR digital image that is dedicated to the display of luminance values inside the operable range of the SDR video to the portion of the HDR digital image that is dedicated to the display of luminance values outside the operable range of the SDR video may then be estimated by taking a relative brightness ratio of the relative brightness for the luminance values at or below the typical luminance value with respect to the relative brightness for the luminance values exceeding the typical luminance value. If the relative brightness ratio does not meet a preset threshold value in an embodiment, it may indicate the majority of content is intended to be displayed within the operable range of an SDR display. If the relative brightness ratio meets or exceeds a preset threshold value in an embodiment, it may indicate the majority of content is intended to be displayed outside the operable range of the SDR display.

In some received HDR digital image data, the majority of content is intended to be displayed within the operable range of an SDR display, such as when the luminance values outside the operable range of the SDR video display are intended to act as highlights that are not central to the content of the HDR digital image. For example, if the majority of the content of the HDR digital image is intended to be displayed inside the operable range of the SDR video display, the adaptive HDR tone mapping system in an embodiment may opt to clip out the luminance values that exceed the operable range of the SDR video display. In such an embodiment, by clipping out the highlights of the HDR digital image, the adaptive HDR tone mapping system in an embodiment may alter the HDR digital image such that the lower resolution SDR video display can display all but the highlights of the content. Employing such a method to cap luminance values not central to the content of the HDR digital image may decrease time and resources devoted to processing the HDR digital image without compromising the integrity of the central content of the HDR digital image.

In a contrasting example, if a majority of the content of the HDR digital image is to be displayed outside the operable range of the SDR video display, an adaptive HDR tone mapping system may opt to compress the luminance values outside the operable range of the SDR video display into the operable range of the SDR video display such that portions of the central content of the HDR digital image is not lost or otherwise distorted. The adaptive HDR tone mapping system in embodiments may then compress the luminance values of the HDR digital image exceeding the peaking display luminance value of the SDR display into the dynamic range of the SDR display.

Such a compression method in an embodiment may include separating the luminance values exceeding the peak luminance value for the display into a plurality of sub-ranges of luminance values. A method may also include comparing the portion of the HDR digital image dedicated to displaying luminance values within each sub-range to the portion of the HDR digital image dedicated to displaying luminance values exceeding the typical luminance value of the SDR display. Such a comparison may be referred to herein as a compression factor, and each sub-range of luminance values may be associated with a separate compression factor.

In embodiments of the present disclosure, a measure of relative brightness for the luminance values within each sub-range may provide an estimate of the portion of the HDR digital image that is dedicated to the display of luminance values inside each sub-range. Similarly, in embodiments, a measure of relative brightness for the luminance values exceeding the typical luminance value of the display may provide an estimate of the portion of the HDR digital image that is dedicated to the display of luminance values exceeding the typical luminance value of the SDR display. The relative brightness for the luminance values within each sub-range, and the relative brightness for the luminance values exceeding the typical luminance value of the SDR display in embodiments may be determined using a similar calculation to the one described above for determining the relative brightness for the luminance values at or below the typical luminance value of the display. A compression factor in embodiments of the present disclosure may then be estimated for each sub-range by taking a ratio of the relative brightness for the luminance values for each sub-range with respect to the relative brightness for the luminance values exceeding the typical luminance value of the SDR display. Upon selecting the second type of compression, the adaptive HDR tone mapping system in embodiments herein may compress the luminance values outside the operable luminance range of the SDR display into the operable luminance range of the SDR display while preserving the contrast details defined in the content of the HDR digital image by the luminance values that originally exceeded the peaking display luminance.

Examples are set forth below with respect to particular aspects of an information handling system for limiting battery charging of computing devices during storage and shipping states.

FIG. 1 illustrates an information handling system 100 similar to information handling systems according to several aspects of the present disclosure. In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, mobile device (e.g., personal digital assistant (PDA) or smart phone), server (e.g., blade server or rack server), a consumer electronic device, a network server or storage device, a network router, switch, or bridge, wireless router, or other network communication device, a network connected device (cellular telephone, tablet device, etc.), IoT computing device, wearable computing device, a set-top box (STB), a mobile information handling system, a palmtop computer, a laptop computer, a desktop computer, a communications device, an access point (AP), a base station transceiver, a wireless telephone, a land-line telephone, a control system, a camera, a scanner, a facsimile machine, a printer, a pager, a personal trusted device, a web appliance, or any other suitable machine capable of executing a set of instructions (sequential or otherwise) that specify actions to be taken by that machine, and can vary in size, shape, performance, price, and functionality.

In a networked deployment, the information handling system 100 may operate in the capacity of a server or as a client computer in a server-client network environment, or as a peer computer system in a peer-to-peer (or distributed) network environment. In a particular embodiment, the computer system 100 can be implemented using electronic devices that provide voice, video or data communication. For example, an information handling system 100 may be any mobile or other computing device capable of executing a set of instructions (sequential or otherwise) that specify actions to be taken by that machine. Further, while a single information handling system 100 is illustrated, the term "system" shall also be taken to include any collection of systems or sub-systems that individually or jointly execute a set, or multiple sets, of instructions to perform one or more computer functions.

The information handling system can include memory (volatile (e.g. random-access memory, etc.), nonvolatile (read-only memory, flash memory etc.) or any combination thereof), one or more processing resources, such as a central processing unit (CPU), a graphics processing unit (GPU) 114, hardware or software control logic, or any combination thereof. Additional components of the information handling system can include one or more storage devices, one or more communications ports for communicating with external devices, as well as, various input and output (110) devices, such as a keyboard, a mouse, a video/graphic display, or any combination thereof. The information handling system can also include one or more buses operable to transmit communications between the various hardware components. Portions of an information handling system may themselves be considered information handling systems.

Information handling system 100 can include devices or modules that embody one or more of the devices or execute instructions for the one or more systems and modules described above, and operates to perform one or more of the methods described above. The information handling system 100 may execute code instructions 124 that may operate on servers or systems, remote data centers, or on-box in individual client information handling systems according to various embodiments herein. In some embodiments, it is understood any or all portions of code instructions 124 may operate on a plurality of information handling systems 100.

The information handling system 100 may include a processor 102 such as a central processing unit (CPU), control logic or some combination of the same. Any of the processing resources may operate to execute code that is either firmware or software code. Moreover, the information handling system 100 can include memory such as main memory 104, static memory 106, computer readable medium 122 storing instructions 124 of the adaptive HDR tone mapping system 132, and drive unit 130 (volatile (e.g. random-access memory, etc.), nonvolatile (read-only memory, flash memory etc.) or any combination thereof). The information handling system 100 can also include one or more buses 108 operable to transmit communications between the various hardware components such as any combination of various input and output (I/O) devices.

As shown, the information handling system 100 may further include an SDR video display 110 or may include some other lower dynamic range video display which a range peak below the HDR video data to be displayed. The SDR video display 110 in an embodiment may function as a liquid crystal display (LCD), an organic light emitting diode (OLED), a flat panel display, or a solid state display. The SDR video display 110 in an embodiment may be an SDR video display for displaying images according to the standard dynamic range of brightness values or some other lower range than received HDR video data. For purposes of this disclosure, the methods and systems taught herein relate to tone mapping between digital video data with a higher dynamic range of brightness values than the video display hardware 110 can support. Whether according applied to a transition from an HDR standard range video data image to an SDR standard range display 110 or a transition between some other set of dynamic ranges, the embodiments of the present disclosure may apply to permit the lower dynamic range video display 110 to support and display image data received with a higher dynamic range. It is understood that embodiments herein may be applied to transition of any ranges from higher dynamic range video data to a lower dynamic range video display 110. The standard dynamic range of brightness values, as described herein, may include any dynamic ranges not adhering to the high dynamic range defined by the Consumer Technology Association HDR-10 media profile standard or later established high definition video standards (e.g. HDR 10+). Additionally, the information handling system 100 may include an alpha numeric input device 112, such as a keyboard, and/or a cursor control device, such as a mouse, touchpad, or gesture or touch screen input. The information handling system 100 can also include a disk drive unit 130 and a graphics processing unit 114. The graphics processing unit 114 in an embodiment may operate to execute the adaptive HDR tone mapping system 132, and to store one or more profiles 124 defining picture settings of the SDR video display 110. For example, profiles 124 may include defined operational luminance values of the SDR video display 110, such as a display luminance minimum value, a display luminance typical value, and a display luminance peaking value. As another example, profiles 124 may include a gaming, movie, or vivid picture setting, wherein each picture setting is associated with a tone mapping method.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. The wireless adapter 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used.

In some embodiments, software, firmware, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionality as described herein.

The information handling system 100 can include a set of instructions 124 that can be executed to cause the computer system to perform any one or more of the methods or computer based functions disclosed herein. For example, instructions 124 may execute an adaptive HDR tone mapping system 132, software agents, or other aspects or components. Various software modules comprising application instructions 124 may be coordinated by an operating system (OS), and/or via an application programming interface (API). An example operating system may include Windows®, Android®, and other OS types known in the art. Example APIs may include Win 32, Core Java API, or Android APIs.

The disk drive unit 130 and the adaptive HDR tone mapping system 132 may include a computer-readable medium 122 in which one or more sets of instructions 124 such as software can be embedded. Similarly, main memory 104 and static memory 106 may also contain a computer-readable medium for storage of one or more sets of instructions, parameters, or profiles 124 including an estimated training duration table. The disk drive unit 130 and static memory 106 also contain space for data storage. Further, the instructions 124 may embody one or more of the methods or logic as described herein. For example, instructions relating to the adaptive HDR tone mapping system 132 software algorithms may be stored here. In a particular embodiment, the instructions, parameters, and profiles 124 may reside completely, or at least partially, within the main memory 104, the static memory 106, and/or within the disk drive 130 during execution by the processor 102 of information handling system 100. As explained, some or all of the adaptive HDR tone mapping system 132 may be executed locally or remotely. The main memory 104 and the processor 102 also may include computer-readable media.

Main memory 104 may contain computer-readable medium (not shown), such as RAM in an example embodiment. An example of main memory 104 includes random access memory (RAM) such as static RAM (SRAM), dynamic RAM (DRAM), non-volatile RAM (NV-RAM), or the like, read only memory (ROM), another type of memory, or a combination thereof. Static memory 106 may contain computer-readable medium (not shown), such as NOR or NAND flash memory in some example embodiments. The adaptive HDR tone mapping system 132 and the drive unit 130 may include a computer-readable medium 122 such as a magnetic disk in an example embodiment. While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

The information handling system 100 may also include an adaptive HDR tone mapping system 132 that may be operably connected to the bus 108. The adaptive HDR tone mapping system 132 computer readable medium 122 may also contain space for data storage. The adaptive HDR tone mapping system 132 may perform tasks related to determining an optimal method of compressing an HDR digital image into an operational luminance range of the SDR video display 110 based on a histogram analysis of the HDR digital image(s) as it is received.

In an embodiment, the adaptive HDR tone mapping system 132 executed by the electromagnetic radiation controller 116 or the processor 102 may communicate with the main memory 104, the processor 102, the SDR video display 110, the alpha-numeric input device 112, sensor hub 114, and the network interface device 120 via bus 108, and several forms of communication may be used, including ACPI, SMBus, a 24 MHZ BFSK-coded transmission channel, or shared memory.

In other embodiments, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

When referred to as a "system", a "device," a "module," a "controller," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a standalone device). The system, device, controller, or module can include software, including firmware embedded at a device, such as an Intel® Core class processor, ARM® brand processors, Qualcomm® mobile device processors, or other processors and chipsets, or other such device, or software capable of operating a relevant environment of the information handling system. The system, device, controller, or module can also include a combination of the foregoing examples of hardware or software. Note that an information handling system can include an integrated circuit or a board-level product having portions thereof that can also be any combination of hardware and software. Devices, modules, resources, controllers, or programs that are in communication with one another need not be in continuous communication with each other, unless expressly specified otherwise. In addition, devices, modules, resources, controllers, or programs that are in communication with one another can communicate directly or indirectly through one or more intermediaries.

Figure 2:
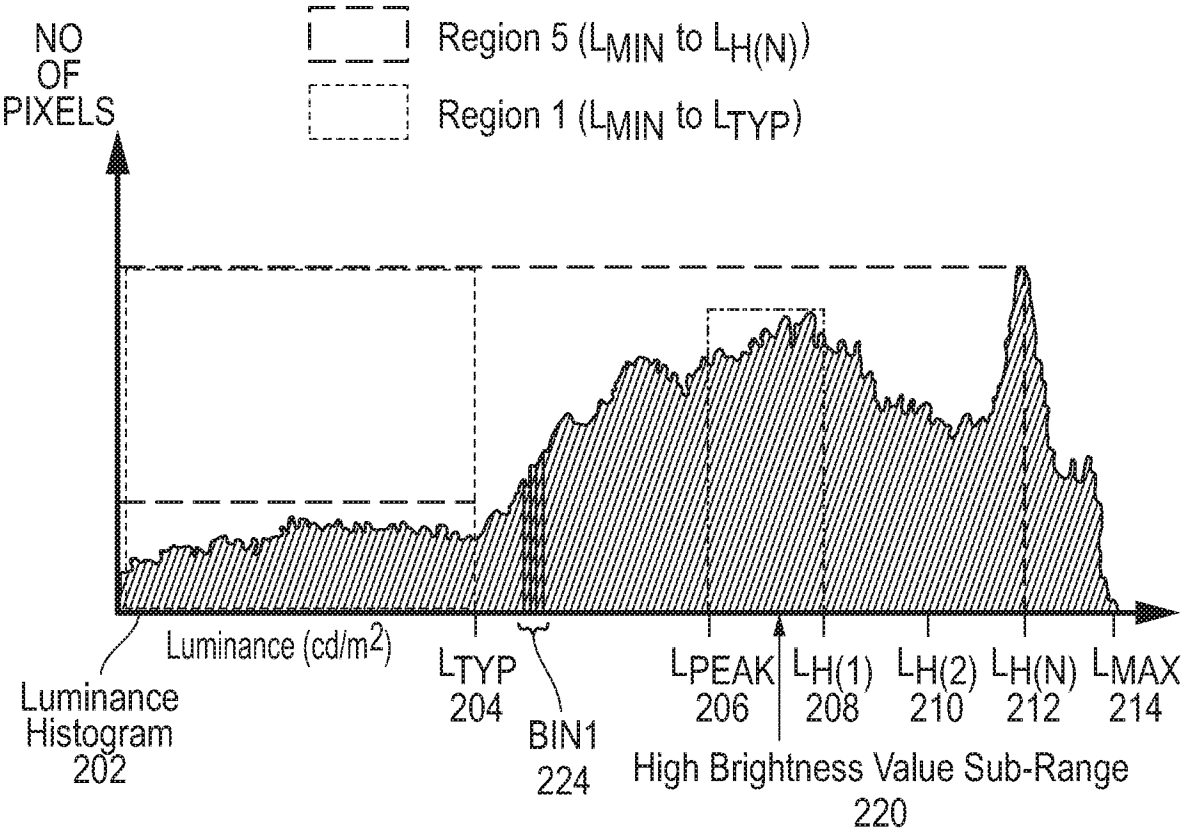
FIG. 2 is an illustration of a luminance histogram according to an embodiment of the present disclosure.

FIG. 2 is an illustration of a luminance histogram of an HDR digital image according to an embodiment of the present disclosure. Upon receiving an HDR digital image in an embodiment, the adaptive HDR tone mapping system may generate a luminance histogram 202, as shown in FIG. 2. The luminance histogram 202 in an embodiment may represent the distribution of brightness values across all pixels in a digital SDR video display based on the received HDR digital image.

The luminance histogram is derived from HDR digital image data which in an embodiment may be expressed as four arrays of values—a first array indicating a number identification of a pixel, a second and third array, each indicating a chroma coordinate (Cb or Cr) within the RGB color space assigned to that pixel according to the image meant to be displayed, and a fourth array indicating a luminance (Y) assigned to that pixel according to the image meant to be displayed, measured in candelas per meter squared. The fourth array may also represent average brightness, or luminance values, also measured in candelas per meter squared. The luminance (Y) may be derived linearly, or may be gamma-corrected (Y'). From the data in the fourth array, the histogram may be determined based on frequency of luminance values within pixels such as shown in an example embodiment of FIG. 2.

The maximum number of luminance values in an HDR digital image may be equivalent to:

$$N_{MAX}=2^B-1$$

where B equals the number of bits in the binary numbers. For example, in a standard dynamic ratio digital image, in which the number of bits in the binary numbers (B) is equivalent to eight, the maximum number of luminance values is equivalent to 255. As another example, in a high dynamic ratio digital image, in which the number of bits in the binary numbers (B) is equivalent to ten, the maximum number of luminance values is equivalent to 1,023. Other embodiments may involve digital images with any maximum number of luminance values. Each bar graph or point plotted across the X axis of the luminance histogram 202 in an embodiment may be associated with one of the number of luminance values in a received HDR digital image, and may describe the number of pixels that are dedicated to displaying at each of the luminance values defined across the X axis, according to the HDR image data.

The adaptive HDR tone mapping system in an embodiment may group or partition all luminance (Y or Y') values in the received arrays into partitioned bins including a plurality of luminance values. For example, each bin may include five luminance values, such as, for example, luminance values between 450 and 454 candelas per meter squared, as represented by bin 1 224 shown in FIG. 2. In other embodiments, each partitioned bin may include other numbers of luminance values, such as ten, twenty, fifty, or one hundred candelas per meter squared.

The adaptive HDR tone mapping system in an embodiment may further analyze the received arrays describing the HDR image in order to determine how many separate pixels fall within each partitioned bin. For example, a first bin 224 grouping luminance values from 450 to 454 candelas per meter squared may be associated with 17 separate pixels, identified as 17 separate data fields within the first array or pixel number identification array. The value 17 in such an embodiment may illustrate the number of data fields in the luminance array (e.g. fourth array) having a luminance value between 450 and 454 candelas per meter squared. The adaptive HDR tone mapping system in an embodiment may repeat this calculation for each defined bin similarly to as described directly above.

The adaptive HDR tone mapping system may generate a luminance histogram 202 of the HDR image described by the pixel array and luminance array by plotting the number of data fields (associated with pixels) within the luminance array that fall within the luminance values of each partitioned luminance bin. The X axis of the luminance histogram 202 in an embodiment may describe the luminance associated with each partitioned luminance bin in candelas per meter squared, from a minimum of zero to a maximum of $L_{MAX}$ at 214 found within the HDR digital image data. The maximum luminance data value in various embodiments of HDR digital image data may vary from one HDR digital image to another, and may reach up to or beyond 10,000 candelas per meter squared.

The adaptive HDR tone mapping system may further determine values for the typical display luminance $L_{TYP}$ 204 and the peaking display luminance $L_{PEAK}$ 206 that are a characteristic of the SDR video display or other lower dynamic range video display device. The $L_{TYP}$ 204 and $L_{PEAK}$ 206 of the SDR video display device may be accessed from memory or in firmware of the SDR video display. For example, $L_{TYP}$ of the SDR video display may be equivalent to 400 cd/m$^2$, and $L_{PEAK}$ of the SDR video display may be equivalent to 600 cd/m$^2$ in an embodiment. In other embodiments, such as embodiments including an Intel SDR video display adhering to SDR standards, $L_{TYP}$ may be equivalent to 300 cd/m$^2$, and $L_{PEAK}$ may be equivalent to 400 cd/m$^2$. It can be appreciated that lower dynamic range SDR video display devices may vary in typical display luminance $L_{TYP}$ and the peaking display luminance $L_{PEAK}$ 206 characteristics depending on the information handling system configuration being administered to by the adaptive HDR tone mapping system of embodiments of the present disclosure. The system and methods of the present disclosure may serve to adapt such SDR video displays to accommodate HDR digital image data with higher ranges with greater efficiency or less distortion.

Luminance values exceeding $L_{PEAK}$ as displayed in the histogram of the HDR image data in an embodiment may represent luminance values the SDR video display is not capable of displaying. Although these values are included in the HDR digital image data, a tone mapping translation must occur in order to display the HDR digital image data using the lower dynamic range SDR video display. In various embodiments, the adaptive HDR tone mapping system must either compress the HDR digital image into the luminance range the SDR video display is capable of displaying, or must clip the portion of the HDR digital image data involving luminance values outside the operable range of the SDR video display. For example, if the majority of the content of the HDR digital image data is intended to be displayed outside the operable range of the SDR video display, the adaptive HDR tone mapping system may opt to compress the luminance values outside the operable range of the SDR video display into the operable range of the SDR video display such that the intent of the HDR digital image is not lost. As a contrasting example, if the majority of the content of the HDR digital image data is intended to be displayed inside the operable range of the SDR video display, the adaptive HDR tone mapping system in an embodiment may opt to clip out the luminance values exceeding the operable range of the SDR video display. In the latter example embodiment, the majority of the content of the HDR digital image data may be inside the operable range of the SDR video display in circumstances where the luminance values outside the operable range of the SDR video display are intended to act as highlights not central to the content of the HDR digital image. In such an embodiment, by clipping out the highlights of the HDR digital image, the adaptive HDR tone mapping system in an embodiment may alter the HDR digital image such that the lower resolution SDR video display can display all but the highlights of the content, thus preserving the contrast of the image.

As described herein, the adaptive HDR tone mapping system in an embodiment may determine which compression method to employ based on a comparison of the portion of the HDR digital image dedicated to displaying the luminance values that fall outside the effective range of the SDR video display to the portion of the HDR image dedicated to displaying luminance values inside the effective range of the SDR video display. The luminance values that fall inside the effective range of the SDR video display in an embodiment may be grouped within a first luminance value region that may include the luminance range of the luminance histogram 202, from zero cd/m$^2$ ($L_{MIN}$) to the typical display luminance $L_{TYP}$ 204 for the target SDR display device. The full luminance range of the luminance histogram 202, from zero cd/m$^2$ at the Y axis (also referred to as $L_{MIN}$ but not shown) to the maximum luminance value $L_{MAX}$ 214 (or an $L_{H(N)}$ value in some embodiments) of the HDR image data may fall within a fifth region, as shown in FIG. 2. The luminance values that fall outside the effective range of the SDR video display in an embodiment may be represented by the portion of region 5 that does not include region 1. Each luminance value region may include a plurality of bins, and each bin may have a number of pixels within the luminance value range attributed to that bin, as measured across the Y axis of the luminance histogram 202.

In embodiments of the present disclosure, a measure of relative brightness for the luminance values at or below the typical luminance value of the display $L_{TYP}$ 204 may provide an estimate of the portion of the HDR digital image that is dedicated to the display of luminance values inside the effective range of the SDR video. The relative brightness for the luminance values at or below the typical luminance value $L_{TYP}$ 204 in embodiments may be equivalent to the total number of pixels (measured along the Y axis of the luminance histogram 202) associated with luminance values at or below the typical luminance value for the SDR display $L_{TYP}$ 204 according to the HDR digital image data, multiplied by the average of all luminance values across region 1 (e.g. associated with each of those pixels according to the HDR digital image data). As described herein, each point plotted across the X axis of the luminance histogram 202 in an embodiment may describe the number of pixels that are dedicated to displaying at each of the luminance values defined across the X axis, according to the HDR image data. In other words, each luminance value defined across the X axis is associated with a pixel value defined across the Y axis. The total number of pixels associated with luminance values at or below the typical luminance value for the SDR display $L_{TYP}$ 206 in an embodiment may be equivalent to the sum of all pixel values associated with a luminance value within region 1 (e.g. at or below the typical luminance value for the SDR display $L_{TYP}$ 204).

A measure of relative brightness for the luminance values exceeding the typical luminance value of the display $L_{TYP}$ 204 may provide an estimate of the portion of the HDR digital image that is dedicated to the display of luminance values outside the effective range of the SDR video, which may be equivalent to the total number of pixels associated with luminance values exceeding the typical luminance value $L_{TYP}$ 204 for the SDR display according to the HDR digital image data, multiplied by the average of all luminance values associated with each of those pixels according to the HDR digital image data. A comparison of the portion of the HDR digital image that is dedicated to the display of luminance values inside the effective range of the SDR video to the portion of the HDR digital image that is dedicated to the display of luminance values outside the effective range of the SDR video may then be estimated by taking a relative brightness ratio of the relative brightness for the luminance values at or below the typical luminance value $L_{TYP}$ 204 with respect to the relative brightness for the luminance values exceeding the typical luminance value $L_{TYP}$ 204.

In an embodiment in which it is determined a majority of the content of the HDR digital image is to be displayed outside the effective range of the SDR video display, an adaptive HDR tone mapping system may opt to compress the luminance values outside the effective range of the SDR video display into the effective range of the SDR video display such that portions of the central content of the HDR digital image is not lost or otherwise distorted. An alternative method for compressing the luminance values outside the effective range of the SDR video display may involve non-linearly compressing the luminance values in the histogram into the SDR video display luminance range in order to avoid over compression and distortion of the image within certain compressed ranges while underutilizing available range for other compressed luminance levels where few pixels have luminance display values. In an example embodiment, the adaptive HDR tone mapping system may need to gauge the emphasis the HDR image data places on each of a plurality of luminance values that exceed the typical luminance of the SDR video display relative to luminance values within the typical display range of the SDR video display. By tailoring the compression to the emphasis the HDR image data places on each luminance value, the adaptive HDR tone mapping system may better preserve the contrast as intended by the HDR image data in some embodiments.

The number of pixels set to display luminance values exceeding the typical luminance level of the SDR video display $L_{TYP}$ may vary for each of the luminance values exceeding the typical luminance level $L_{TYP}$. For example, as shown in FIG. 2, the number of pixels set to display at the luminance values between $L_{TYP}$ 204 and $L_{MAX}$ 214 varies substantially across the X axis (e.g. luminance values). If a large number of pixels are associated with a first luminance value (or first set of luminance values) and a relatively small number of pixels are associated with a second luminance value (or second set of luminance values), the HDR image data has placed a greater emphasis on the first luminance value (or set) than on the second luminance value (or set). As such, the HDR tone mapping system in an embodiment may compress the second luminance value (or set) by a greater factor than it compresses the first luminance value (or set). Doing so may better preserve the original contrast of the HDR image data.

In order to determine the factor by which each luminance value should be compressed according to the non-linear approach, the HDR tone mapping system in an embodiment may identify one or more key luminance values between $L_{PEAK}$ 206 and $L_{MAX}$ 214. For example, the HDR tone mapping system in an embodiment may define high brightness values numbering 1 to N. As shown in FIG. 2, the HDR tone mapping system has defined high brightness values $L_{H(1)}$ 208, $L_{H(2)}$ 210, and $L_{H(N)}$ 212. The variable N may have any value equivalent to or greater than one, and $L_{H(N)}$ may be equivalent to $L_{MAX}$ 214 in some embodiments or may be a different value as shown in FIG. 2. Each of these high brightness values (e.g. $L_{H(1)}$ to $L_{H(N)}$) in an embodiment may define the upper boundary of a high brightness value sub-ranges. For example, $L_{H(1)}$ may define an upper limit to a high brightness sub-range 220 describing all luminance values between $L_{PEAK}$ and $L_{H(1)}$. The HDR tone mapping system in an embodiment may identify a number M of high brightness value sub-ranges, wherein the number M of high brightness value sub-ranges is equivalent to the number N of key luminance values identified. In such an embodiment, the Mth sub-range may have an upper bound of the Nth key luminance value, and a lower bound of the (N−1)th key luminance value (or the $L_{PEAK}$ if N=1).

The adaptive HDR tone mapping system in an embodiment may then separate the luminance values exceeding the peak luminance value for the display $L_{PEAK}$ 206 into a plurality of N sub-ranges of high luminance values. For example, the adaptive HDR tone mapping system in an embodiment may separate the luminance values exceeding the peak luminance value for the display $L_{PEAK}$ 206 into a first high brightness value sub-range 220 including luminance values between $L_{PEAK}$ 206 and $L_{H(1)}$ 208, a second high brightness value sub-range (not shown) including luminance values between $L_{H(1)}$ 208 and $L_{H(2)}$ 210, and a third high brightness value sub-range (not shown) including luminance values between $L_{H(2)}$ 210 and $L_{H(N)}$ 212. In some embodiments, the luminance value $L_{H(N)}$ 212 may be equivalent to the luminance value $L_{MAX}$ 214.

The adaptive HDR tone mapping system may then compare the portion of the HDR digital image dedicated to displaying luminance values within each sub-range (e.g. the first, second, and third sub-ranges described directly above) to the portion of the HDR digital image dedicated to displaying luminance values exceeding the typical luminance value of the SDR display. Such a comparison may be referred to herein as a compression factor, and each sub-range of luminance values may be associated with a separate compression factor, as described herein.

FIG. 3 is a diagram illustrating a region luminance table based on analysis of an example histogram of a digital image including a small portion of content outside the operable luminance range of an SDR video display according to a first embodiment of the present disclosure. As described herein, the adaptive HDR tone mapping system in an embodiment may compress HDR digital image data into a luminance range within the effective luminance range of an SDR video display by either clipping the luminance values outside the operable luminance range, or by compressing, linearly or non-linearly, those values into the effective luminance range. The adaptive HDR tone mapping system in an embodiment may determine which of these methods to use based upon a comparison of the portion of the HDR digital image dedicated to displaying the luminance values that fall outside an effective range of the SDR video display to the portion of the HDR image dedicated to displaying luminance values inside the effective range of the SDR video display.

As part of this process, the adaptive HDR tone mapping system in an embodiment may identify a plurality of key regions, each associated with a sub-range of luminance values across the X axis of the histogram in an embodiment. For example, regions are identified in row 308 have a lower bound luminance value (in cd/m$^2$) given in row 304 and an upper bound luminance value (in cd/m$^2$) given in row 306 of the region luminance table 302. Key luminance values in an embodiment described with reference to FIG. 3 may include an $L_{MIN}$ equivalent to zero cd/m$^2$, an $L_{TYP}$ equivalent to 400 cd/m$^2$, an $L_{PEAK}$ equivalent to 600 cd/m$^2$, an $L_{H(1)}$ equivalent to 1,000 cd/m$^2$, an $L_{H(2)}$ equivalent to 2,000 cd/m$^2$, and an $L_{H(N)}$ or $L_{MAX}$ equivalent to 4,000 cd/m$^2$. These values are only examples and other embodiments may include other values based on the luminance range of the SDR video display and on the histogram analysis of received HDR digital image data.

As an example of separating the luminance values of a histogram into multiple luminance regions, the adaptive HDR tone mapping system may define a first region shown in column 314 of table 302 having a lower bound of zero cd/m$^2$ and an upper bound of $L_{TYP}$, second region shown in column 316 having a lower bound of zero cd/m$^2$ and an upper bound of $L_{PEAK}$, a third region shown in column 318 having a lower bound of zero cd/m$^2$ and an upper bound of $L_{H(1)}$, a fourth region shown in column 320 having a lower bound of zero cd/m$^2$ and an upper bound of $L_{H(2)}$, a fifth region shown in column 322 of table 302 having a lower bound of zero cd/m$^2$ and an upper bound of $L_{H(N)}$. As shown in table 302, regions 1-5 may each have a lower bound of zero cd/m$^2$.

As another example of separating the luminance values of a histogram into multiple luminance regions, the adaptive HDR tone mapping system may define a sixth region shown in column 324 having a lower bound of $L_{TYP}$ and an upper bound of $L_{PEAK}$, a seventh region shown in column 326 having a lower bound of $L_{TYP}$ and an upper bound of $L_{H(1)}$, an eight region shown in column 328 having a lower bound of $L_{TYP}$ and an upper bound of $L_{H(2)}$, and a ninth region shown in column 330 having a lower bound of $L_{TYP}$ and an upper bound of $L_{H(N)}$. As shown in table 302, regions 6 through 9 may each have a lower bound of $L_{TYP}$.

In embodiments of the present disclosure, a measure of relative brightness for the luminance values at or below the typical luminance value of the display (e.g. within region 1) may provide an estimate of the portion of the HDR digital image that is dedicated to the display of luminance values inside the effective range of the SDR video. The relative brightness $RB_{RN}$ for the luminance values within region N in embodiments may be equivalent to the total number of pixels associated with luminance values within that region according to the HDR digital image data, multiplied by the average of all luminance values within that region according to the HDR digital image data.

$$\text{Relative Brightness}_{RN} = P_{RN} \times L_AVG_{RN}$$

where P=number of pixels, and L_AVG=average luminance value (cd/m$^2$).

For example, as shown in FIG. 3 at row 310, column 314, the relative brightness $RB_{R1}$ for region 1 (e.g. luminance values between $L_{MIN}$ and $L_{TYP}$) may be equivalent to 320 cd/m$^2$. A similar method may be used to identify a relative brightness $RB_{R2}$ for region 2 of 340 cd/m$^2$, as shown at row 310, column 316, a relative brightness $RB_{R3}$ for region 3 of 349 cd/m$^2$, as shown at row 310, column 318, a relative brightness $RB_{R4}$ for region 4 of 350 cd/m$^2$, as shown at row 310, column 320, a relative brightness $RB_{R5}$ for region 5 of 350 cd/m$^2$, as shown at row 310, column 322, a relative brightness $RB_{R6}$ for region 6 of 430 cd/m$^2$, as shown at row 310, column 324, a relative brightness $RB_{R7}$ for region 7 of 450 cd/m$^2$, as shown at row 310, column 326, a relative brightness $RB_{R8}$ for region 8 of 450 cd/m$^2$, as shown at row 310, column 328, and a relative brightness $RB_{R9}$ for region 9 of 450 cd/m$^2$, as shown at row 310, column 330.

A comparison of the portion of the HDR digital image that is dedicated to the display of luminance values inside the effective range of the SDR video to the portion of the HDR digital image that is dedicated to the display of luminance values outside the effective range of the SDR video may then be estimated by taking a relative brightness ratio of the relative brightness for the luminance values at or below the typical luminance value with respect to the relative brightness for the luminance values exceeding the typical luminance value. As described herein, the relative brightness for the luminance values exceeding the typical luminance value may be determined by subtracting the relative brightness for region 1 (from $L_{MIN}$ to $L_{TYP}$) from the relative brightness for region 5 (from $L_{MIN}$ to $L_{MAX}$). As shown at column 314 in table 302, the relative brightness of region 1 ($RB_{R1}$) may be equivalent to 320. As shown at column 322 in table 302, the relative brightness of region 5 ($RB_{R5}$) may be equivalent to 350. Using these numbers, the adaptive HDR tone mapping system in an embodiment may determine the relative brightness ratio equivalent to $$\text{Relative Brightness Ratio} = \frac{RB_{R5} - RB_{R1}}{RB_{R1}} = \frac{(350 - 320)}{320} = 0.09 \text{ or } 9\%$$

The relative brightness ratio may provide a rough estimate of the proportion of the HDR digital image data content that is associated with luminance ranges outside of the typical range of the SDR video display to the content that is associated with luminance ranges within the typical range of the SDR video display. This may be the case for example, if the majority of content for the HDR digital image data falls within the typical range of the SDR video display. Thus, the region luminance table 302 may be associated with an embodiment in which the majority of content for the HDR digital image data falls within the typical range of the SDR video display.

For example, the relative brightness ratio being equivalent to 9% may indicate a relatively low proportion of the HDR digital image data content is associated with luminance ranges outside of the typical range of the SDR video display. If the relative brightness ratio is below a preset threshold, the adaptive HDR tone mapping system in an embodiment may opt to clip out all luminance values exceeding the operable display luminance range (e.g. exceeding $L_{PEAK}$) in an embodiment. The preset threshold in an embodiment may have any value and may be preset at any time prior to receipt of the HDR digital image data. For example, if the preset threshold is 10%, the relative brightness ratio equivalent to 9% may fall below this preset threshold value, and the adaptive HDR tone mapping system in such an embodiment may compress the HDR digital image by clipping out all luminance values greater than $L_{PEAK}$. This is only one example of a preset threshold. Other embodiments may include preset thresholds having any value between zero and 100%, including but not limited to 20% and 80%.

Other embodiments may include any number of luminance regions exceeding $L_{PEAK}$ (e.g. as defined by an upper bound between $L_{H(1)}$ and $L_{H(N)}$). The number of regions may be preset prior to receipt of the HDR digital image. A greater number of regions in an embodiment may be used with a result in greater preservation of contrast between luminance values exceeding $L_{PEAK}$ if the adaptive HDR tone mapping system in an embodiment opts to compress these high-luminance values into the operable luminance range of the SDR video display.

In some embodiments, data for several HDR digital images may be analyzed prior to determining which compression method to employ. For example, each of the several HDR digital images may be associated with a separate region luminance table, and the calculation described directly above may be made for each of these tables. The determined relative brightness of the highest luminance regions (e.g. region 5 in table 302) in each of these tables may then be averaged and compared against the preset threshold. In some embodiments, the values of $L_{H(1)}$ to $L_{H(N)}$ may vary from image to image, and the value of N may vary from image to image, since the histograms may vary from image to image.

The adaptive HDR tone mapping system in an embodiment may determine the sub-range compression factors shown in row 312 of table 302 only after determining the relative brightness ratio meets or exceeds the preset threshold. Because the adaptive HDR tone mapping system in the described embodiment determined above that the relative brightness ratio did not meet the preset threshold of 10%, the adaptive HDR tone mapping system in such an embodiment may not determine or store any values for the sub-range compression factors of any of regions 1-9.

FIG. 4 is a block diagram illustrating an output luminance table based on analysis of a histogram of a digital image including a small portion of content outside the operable luminance range of an SDR video display according to a first embodiment of the present disclosure. As described above with reference to FIG. 3, the adaptive HDR tone mapping system in some embodiments may determine the relative brightness ratio does not meet a preset threshold value. In such an embodiment, the adaptive HDR tone mapping system may opt to clip all luminance values in the HDR digital image exceeding the peaking display luminance $L_{PEAK}$. The adaptive HDR tone mapping system in such an embodiment may refer to the output luminance table 402 in order to map input luminance values received in array format of the HDR digital image data to edited or compressed output luminance values for display on an SDR video display.

An output luminance table 402 in an embodiment in which the relative brightness ratio does not meet a preset threshold value may include a first column 418 providing the input luminance values. The input luminance values of column 418 may be given in cd/m$^2$ and may be drawn directly from the received array format of the HDR digital image, or may include only key input luminance values drawn from the received array format of the HDR digital image data. For example, column 418 may include luminance values between zero and 10,000 cd/m$^2$. The second column 420 of table 402 may define the effective display range between $L_{TYP}$ and $L_{PEAK}$ in cd/m$^2$. For example, in an embodiment in which the typical display luminance value $L_{TYP}$ is 400 cd/m$^2$, and the peak display luminance value $L_{PEAK}$ is 600 cd/m$^2$, the effective display range may be equivalent to 200 cd/m$^2$. The third column 422 of table 402 may include sub-range compression factors for the region in which each of the input luminance values shown in column 418 fall. In the current embodiment of FIG. 4, the adaptive HDR tone mapping method selected is to clip the values the sub-range compression factors are not used. In other embodiments in which the adaptive HDR tone mapping system opts to compress the luminance value exceeding $L_{PEAK}$ into the operable display range of the SDR video display, the sub-range pixel compression factors are used as described in other embodiments herein.

Column 424 of table 402 may provide compressed output luminance values in cd/m$^2$, based on the method employed by the adaptive HDR tone mapping system to compress the high luminance values of the input HDR image data. For example, in an embodiment in which the relative brightness ratio does not meet a preset threshold value, the adaptive HDR tone mapping system may employ a compression method involving cropping out or capping all luminance values exceeding the peaking display luminance $L_{PEAK}$ for the SDR video display device. For example, as shown in column 424 of table 402, the adaptive HDR tone mapping system may compress the input luminance values of column 418 into the effective display range between $L_{TYP}$ and $L_{PEAK}$ by capping the input luminance values exceeding the peaking display luminance $L_{PEAK}$ of 600 cd/m$^2$ at the peaking display luminance of 600 cd/m$^2$ when the HDR digital image data is displayed on the SDR video display device.

FIG. 5 is a block diagram illustrating a region luminance table based on analysis of a histogram of a digital image including a large portion of content outside the operable luminance range of an SDR video display according to a second embodiment of the present disclosure. As described herein, the adaptive HDR tone mapping system in an embodiment may determine which method to use to compress input luminance values exceeding the peaking display luminance into the effective luminance range of an SDR video display based upon a comparison of the portion of the HDR digital image dedicated to displaying luminance values outside the effective range of the SDR video display to the portion of the HDR digital image dedicated to displaying luminance values inside the effective range of the SDR video display. Further, if the adaptive HDR tone mapping system in an embodiment opts to compress these values into the effective range of the SDR video display, the adaptive HDR tone mapping system may determine how to compress those values. Compression into the effective range of the SDR video display device may be based on a ratio between the relative brightness of each of a plurality of high brightness value sub-ranges to the relative brightness of the region between the typical display luminance and the maximum luminance within the HDR digital image.

As part of this process, the adaptive HDR tone mapping system in an embodiment may identify a plurality of key regions, each associated with a sub-range of luminance values across the X axis of the histogram in an embodiment. For example, regions identified in row 508 have a lower bound luminance value (in cd/m$^2$) given in row 504 and an upper bound luminance value (in cd/m$^2$) given in row 506 of the region luminance table 502. Key luminance values in an embodiment described with reference to FIG. 5 may include an $L_{MIN}$ equivalent to zero cd/m$^2$, an $L_{TYP}$ equivalent to 400 cd/m$^2$, an $L_{PEAK}$ equivalent to 600 cd/m$^2$, an $L_{H(1)}$ equivalent to 1,000 cd/m$^2$, an $L_{H(2)}$ equivalent to 2,000 cd/m$^2$, and an $L_{H(N)}$ or $L_{MAX}$ equivalent to 4,000 cd/m$^2$. These values are only examples and other embodiments may include other values based on the luminance range of the SDR video display and on the histogram analysis of received HDR digital image data.

As an example of separating the luminance values of a histogram into multiple luminance regions, the adaptive HDR tone mapping system may define a first region shown in column 514 of table 502 having a lower bound of zero cd/m$^2$ and an upper bound of $L_{TYP}$, second region shown in column 516 having a lower bound of zero cd/m$^2$ and an upper bound of $L_{PEAK}$, a third region shown in column 518 having a lower bound of zero cd/m$^2$ and an upper bound of $L_{H(1)}$, a fourth region shown in column 520 having a lower bound of zero cd/m$^2$ and an upper bound of $L_{H(2)}$, a fifth region shown in column 522 of table 502 having a lower bound of zero cd/m$^2$ and an upper bound of $L_{H(N)}$. As shown in table 502, regions 1-5 may each have a lower bound of zero cd/m$^2$.

As another example of separating the luminance values of a histogram into multiple luminance regions, the adaptive HDR tone mapping system may define a sixth region shown in column 524 having a lower bound of $L_{TYP}$ and an upper bound of $L_{PEAK}$, a seventh region shown in column 526 having a lower bound of $L_{TYP}$ and an upper bound of $L_{H(1)}$, an eight region shown in column 528 having a lower bound of $L_{TYP}$ and an upper bound of $L_{H(2)}$, and a ninth region shown in column 530 having a lower bound of $L_{TYP}$ and an upper bound of $L_{H(N)}$. As shown in table 502, regions 6 through 9 may each have a lower bound of $L_{TYP}$.

In embodiments of the present disclosure, a measure of relative brightness for the luminance values at or below the typical luminance value of the display (e.g. within region 1) may provide an estimate of the portion of the HDR digital image that is dedicated to the display of luminance values inside the effective range of the SDR video. The relative brightness $RB_{RN}$ for the luminance values within region N in embodiments may be equivalent to the total number of pixels associated with luminance values within that region according to the HDR digital image data, multiplied by the average of all luminance values within that region according to the HDR digital image data.

$$\text{Relative Brightness}_{RN}=P_{RN}=P_{RN}\times L_\text{AVG}_{RN}$$

where P=number of pixels, and L_AVG=average luminance value (cd/m$^2$).

For example, as shown in FIG. 5 at row 510, column 514, the relative brightness $RB_{R1}$ for region 1 (e.g. luminance values between $L_{MIN}$ and $L_{TYP}$) may be equivalent to 320 cd/m$^2$. A similar method may be used to identify a relative brightness $RB_{R2}$ for region 2 of 400 cd/m$^2$, as shown at row 510, column 516, a relative brightness $RB_{R3}$ for region 3 of 500 cd/m$^2$, as shown at row 510, column 518, a relative brightness $RB_{R4}$ for region 4 of 600 cd/m$^2$, as shown at row 510, column 520, a relative brightness $RB_{R5}$ for region 5 of 600 cd/m$^2$, as shown at row 510, column 522, a relative brightness $RB_{R6}$ for region 6 of 500 cd/m$^2$, as shown at row 510, column 524, a relative brightness $RB_{R7}$ for region 7 of 800 cd/m$^2$, as shown at row 510, column 526, a relative brightness $RB_{R8}$ for region 8 of 1500 cd/m$^2$, as shown at row 510, column 528, and a relative brightness $RB_{R9}$ for region 9 of 2000 cd/m$^2$, as shown at row 510, column 530.

A comparison of the portion of the HDR digital image that is dedicated to the display of luminance values inside the effective range of the SDR video to the portion of the HDR digital image that is dedicated to the display of luminance values outside the effective range of the SDR video may then be estimated by taking a relative brightness ratio of the relative brightness for the luminance values at or below the typical luminance value with respect to the relative brightness for the luminance values exceeding the typical luminance value. As described herein, the relative brightness for the luminance values exceeding the typical luminance value may be determined by subtracting the relative brightness for region 1 (from $L_{MIN}$ to $L_{TYP}$) from the relative brightness for region 5 (from $L_{MIN}$ to $L_{MAX}$). As shown at column 514 in table 502, the relative brightness of region 1 ($RB_{R1}$) may be equivalent to 320. As shown at column 522 in table 502, the relative brightness of region 5 ($RB_{R5}$) may be equivalent to 600. Using these numbers, the adaptive HDR tone mapping system in an embodiment may determine the relative brightness ratio equivalent to $$\text{Relative Brightness Ratio}=\frac{RB_{R5}-RB_{R1}}{RB_{R1}}=\frac{(600-320)}{320}=0.88 \text{ or } 88\%$$

The relative brightness ratio may provide a rough estimate of the proportion of the HDR digital image content that is associated with luminance ranges outside of the typical range of the SDR video display to the content that is associated with luminance ranges within the typical range of the SDR video display. This may be the case for example, if the majority of content for the HDR digital image falls outside the typical range of the SDR video display, in the higher luminance values above $L_{PEAK}$. In such a scenario, the adaptive HDR tone mapping system in an embodiment may opt to compress the luminance values exceeding the operable luminance range of the SDR video display into the operable luminance range of the SDR video display, as described herein.

For example, the relative brightness ratio being equivalent to 88% may indicate a relatively high proportion of the HDR digital image content is associated with luminance ranges outside of the effective range of the SDR video display. If the relative brightness ratio is above a preset threshold, the adaptive HDR tone mapping system in an embodiment may opt to compress all luminance values exceeding the operable display luminance range (e.g. exceeding $L_{PEAK}$) into the operable display luminance (e.g. below $L_{PEAK}$) in an embodiment. The preset threshold in an embodiment may have any value and may be preset at any time prior to receipt of the HDR digital image. For example, if the preset threshold is 10%, the relative brightness ratio equivalent to 88% may exceed this preset threshold value, and the adaptive HDR tone mapping system in such an embodiment may compress the HDR digital image by compressing all luminance values greater than $L_{PEAK}$ into the operable display luminance (e.g. below $L_{PEAK}$) in an embodiment. It is understood that any preset threshold level may be used with the relative brightness ratio.

Other embodiments may include any number of luminance regions exceeding $L_{PEAK}$ (e.g. as defined by an upper bound between $L_{H(1)}$ and $L_{H(N)}$). The number of regions may be preset prior to receipt of the HDR digital image. The number of regions K in an embodiment may be equivalent to (2*N)+3, where N is the number of key luminance values. For example, in an embodiment in which N=3, as shown in FIG. 5, there may be (2*3)+3, or 9 regions. As another example, in an embodiment in which N=20, there may be (2*20)+3 or 43 regions. A greater number of regions in an embodiment may result in greater preservation of contrast between luminance values exceeding $L_{PEAK}$ if the adaptive HDR tone mapping system in an embodiment opts to compress these high-luminance values into the operable luminance range of the SDR video display.

As described herein, if the adaptive HDR tone mapping system in an embodiment determines from the relative brightness ratio threshold to compress the portion of the HDR digital image associated with luminance values outside the operable range of the SDR video display into the operable range of the SDR video display, the HDR tone mapping system may determine an optimal way to compress that portion into the operable range of the SDR video display in order to optimize contrast. Methods for compressing the luminance values outside the operable range of the SDR video display may involve linear compression in one embodiment. In another embodiment, non-linear compression may be utilized. Non-linearly compressing the luminance values in the histogram into the SDR video display luminance range may avoid over compression and distortion of the image. In order to perform a non-linear compression, the HDR tone mapping system may need to gauge the emphasis the HDR image places on each of a plurality of luminance values or luminance value sub-ranges that exceed the typical luminance of the SDR video display relative to luminance levels within the typical display range of the SDR video display.

In order to determine the factor by which each luminance value should be compressed according to the non-linear approach, the HDR tone mapping system in an embodiment may identify the one or more key luminance values between $L_{PEAK}$ and $L_{MAX}$ that define the regions 1 through 9. As shown in FIG. 5, the HDR tone mapping system has defined high brightness values $L_{H(1)}$ of 1,000 cd/m$^2$, $L_{H(2)}$ of 2,000 cd/m$^2$, and $L_{H(N)}$ of 4,000 cd/m$^2$. Each of these high brightness values, as well as the peaking display brightness (e.g. $L_{PEAK}$ to $L_{H(N)}$) in an embodiment, may define the boundaries of one or more high brightness value sub-ranges. For example, $L_{H(1)}$ may define an upper limit to a first high brightness sub-range (e.g. region 6) describing all luminance values between $L_{PEAK}$ and $L_{H(1)}$. The relative brightness of this first high brightness sub-range may be shown in FIG. 5 and column 524, row 510 as 500 cd/m$^2$. The relative brightness associated with all luminance values exceeding the typical display brightness $L_{TYP}$ in an embodiment may be equivalent to the relative brightness of region 9 spanning from $L_{TYP}$ to $L_{H(N)}$ given by the value 2,000 cd/m$^2$ at column 530, row 510, minus the typical display luminance given by 400 cd/m$^2$. The adaptive HDR tone mapping system in an embodiment may determine the sub-range compression factor for a first high brightness sub-range having an upper bound of the peaking display luminance value $L_{PEAK}$ using the formula:

$$\text{Sub-range Compression } Factor_M = \frac{RB_{R(S)}}{RB_{R(T)} - L_{TYP}}$$

where M=1, T=maximum number of key luminance values=(2*N)+3, and S=N+M+2. For example, as shown in column 524 at row 512, the adaptive HDR tone mapping system in an embodiment may determine the sub-range compression factor for the first high brightness sub-range where M=1, N=3, T=(2*3)+3=9, and S=N+M+2=6 using the formula $$\text{Sub-range Compression } Factor_1 = \frac{RB_{R6}}{RB_{R9} - L_{TYP}} = \frac{500}{2{,}000 - 400} = 0.0625$$

As another example, $L_{H(1)}$ may define an upper limit to a second high brightness sub-range describing all luminance values between $L_{PEAK}$ and $L_{H(1)}$. The relative brightness of the second high brightness sub-range may be equivalent to the relative brightness of region 7 spanning from $L_{TYP}$ to $L_{H(1)}$ given by the value 800 cd/m$^2$ at column 526, row 510, minus the relative brightness of region 6 spanning from $L_{TYP}$ to $L_{PEAK}$ given by the value 500 cd/m$^2$ at column 524, row 510. As another example, $L_{H(2)}$ may define an upper limit to a third high brightness sub-range describing all luminance values between $L_{H(1)}$ and $L_{H(2)}$. The relative brightness of this third high brightness sub-range may be equivalent to the relative brightness of region 8 spanning from $L_{TYP}$ to $L_{H(2)}$ given by the value 1,500 cd/m$^2$ at column 528, row 510, minus the relative brightness in region 7 spanning from $L_{TYP}$ to $L_{H(1)}$ given by the value 800 cd/m$^2$ at column 526, row 510. As yet another example, $L_{H(N)}$ may define an upper limit to a fourth high brightness sub-range describing all luminance values between $L_{H(2)}$ and $L_{H(N)}$. The relative brightness associated with luminance values in this fourth high brightness sub-range may be equivalent to the relative brightness in region 9 spanning from $L_{TYP}$ to $L_{H(N)}$ given by the value 2,000 cd/m$^2$ at column 530, row 510, minus the relative brightness in region 8 spanning from $L_{TYP}$ to $L_{H(2)}$ given by the value 1,500 cd/m$^2$ at column 528, row 510.

In an embodiment, the adaptive HDR tone mapping system may determine the sub-range compression factors for regions numbered M, where M is greater than one, T=maximum number of key luminance values=(2*N)+3, and S=N+M+2, using the formula:

$$\text{Sub-range Compression } Factor_M = \frac{RB_{R(S)} - RB_{R(S-1)}}{RB_{R(T)} - L_{TYP}}$$

For example, for a second high-brightness sub-range having luminance values between $L_{PEAK}$ and $L_{H(1)}$ in an embodiment, M may have a value of 2. If N=3, and T=(2*N)+3, T may have a value of 9, as shown in FIG. 5. Further, if S=N+M+2, S may have a value of 7. As shown in column 526 at row 512, the sub-range compression factor for high-brightness sub-range 2 in such an embodiment may be determined as:

$$\text{Sub-Range Compression } Factor_2 = \frac{RB_{R7} - RB_{R6}}{RB_{R9} - L_{TYP}} = \frac{800 - 500}{2{,}000 - 400} = 0.1875$$

As another example, for a third high-brightness sub-range having luminance values between $L_{H(1)}$ and $L_{H(2)}$ in an embodiment, M may have a value of 3. If N=3, and T=(2*N)+3, T may have a value of 9, as shown in FIG. 5. Further, if S=N+M+2, S may have a value of 8. As shown in column 528 at row 512, the sub-range compression factor for high-brightness sub-range 3 in such an embodiment may be determined as:

$$\text{Sub-Range Compression } Factor_3 = \frac{RB_{R8} - RB_{R7}}{RB_{R9} - L_{TYP}} = \frac{1{,}500 - 800}{2{,}000 - 400} = 0.4375$$

As yet another example, for a fourth high-brightness sub-range having luminance values between $L_{H(2)}$ and $L_{H(N)}$ in an embodiment, M may have a value of 4. If N=3, and T=(2*N)+3, T may have a value of 9, as shown in FIG. 5. Further, if S=N+M+2, S may have a value of 9. As shown in column 530 at row 512, the sub-range compression factor for high-brightness sub-range 4 in such an embodiment may be determined as:

$$\text{Sub-Range Compression } Factor_4 = \frac{RB_{R9} - RB_{R8}}{RB_{R9} - L_{TYP}} = \frac{2{,}000 - 1{,}500}{2{,}000 - 400} = 0.3125$$

FIG. 6 is a block diagram illustrating an output luminance table based on analysis of a histogram of a digital image including a large portion of content outside the operable luminance range of an SDR video display according to a second embodiment of the present disclosure. As described above with reference to FIG. 5, the adaptive HDR tone mapping system in some embodiments may determine the relative brightness ratio meets or exceeds a preset threshold value. In such an embodiment, the adaptive HDR tone mapping system may opt to compress luminance values in the HDR digital image data exceeding the peaking display luminance $L_{PEAK}$ into the effective display luminance range between $L_{TYP}$ and $L_{PEAK}$ of the SDR display device. The adaptive HDR tone mapping system in such an embodiment may refer to the output luminance table 602 in order to map input luminance values received in array format of the HDR digital image to edited or compressed output luminance values.

An output luminance table 602 in an embodiment in which the relative brightness ratio meets or exceeds a preset threshold value may include a first column 618 providing the input luminance values 604-616. The input luminance values of column 618 may be given in cd/m$^2$ and may be drawn directly from the received array format of the HDR digital image data, or may include only key input luminance values drawn from the received array format of the HDR digital image data. For example, column 618 may include luminance values between zero and 10,000 cd/m$^2$. The second column 620 of table 602 may define the effective display range between $L_{TYP}$ and $L_{PEAK}$ in cd/m$^2$. For example, in an embodiment in which the typical display luminance value $L_{TYP}$ is 400 cd/m$^2$, and the peak display luminance value $L_{PEAK}$ is 600 cd/m$^2$, the effective display range may be equivalent to 200 cd/m$^2$. The third column 622 of table 602 may provide sub-range compression factors for the high-luminance value sub-range in which each of the input luminance values shown in column 618 fall, in embodiments in which the adaptive HDR tone mapping system opts to compress the luminance value exceeding $L_{PEAK}$ into the typical display range of the SDR video display. For example, in an embodiment described with reference to FIG. 5, the input luminance having a value of 4,000 cd/m$^2$ may fall within sub-range 4, which may be associated in column 530 of FIG. 5 and row 606 of FIG. 6 with a sub-range compression factor of 0.3125. As another example, in an embodiment described with reference to FIG. 5, the input luminance having a value of 2,000 cd/m$^2$ may fall within sub-range 3, which may be associated in column 528 of FIG. 5 and row 608 of FIG. 6 with a compression factor of 0.4375. As another example, in an embodiment described with reference to FIG. 5, the input luminance having a value of 1,000 cd/m$^2$ may fall within sub-range 2, which may be associated in column 526 of FIG. 5 and row 610 of FIG. 6 with a compression factor of 0.1875. As yet another example, in an embodiment described with reference to FIG. 5, the input luminance having a value of 600 cd/m$^2$ may fall within sub-range 1, which may be associated in column 524 of FIG. 5 and row 612 of FIG. 6 with a compression factor of 0.0625.

Column 624 of table 602 may provide compressed output luminance values in cd/m$^2$, based on the method employed by the adaptive HDR tone mapping system to compress the high luminance values of the input HDR image. For example, in an embodiment in which the relative brightness ratio meets or exceeds a preset threshold value, the adaptive HDR tone mapping system may employ a compression method involving compressing all luminance values exceeding the peaking display luminance $L_{PEAK}$ into the effective display range between $L_{TYP}$ and $L_{PEAK}$.

For example, as shown in column 624 and row 606 of table 602, the adaptive HDR tone mapping system may compress the input luminance value of 4,000 cd/m$^2$ into the effective display range between $L_{TYP}$ and $L_{PEAK}$ by multiplying the input luminance by its associated sub-range compression factor of 0.3125. In such a way, the adaptive HDR tone mapping system may associate input luminance values of 4,000 cd/m$^2$ with a compressed output luminance value of 600 cd/m$^2$, which is equivalent to the peaking display luminance $L_{PEAK}$. Similarly, as shown in column 624 and row 608 of table 602, the adaptive HDR tone mapping system may compress the input luminance value of 2,000 cd/m$^2$ by multiplying the input luminance by its associated sub-range compression factor of 0.4375 to reach a compressed output luminance value of 537.5 cd/m$^2$, may compress the input luminance value of 1,000 cd/m$^2$ by multiplying the input luminance by its associated sub-range compression factor of 0.1875 to reach a compressed output luminance value of 450 cd/m$^2$, and may compress the input luminance value of 600 cd/m$^2$ equivalent to $L_{PEAK}$ by multiplying the input luminance by its associated sub-range compression factor of 0.0625 to reach a compressed output luminance value of 412.5 cd/m$^2$.

If any of the input luminance values shown in column 618 exceed the set value $L_{H(N)}$ in an embodiment, the adaptive HDR tone mapping system in an embodiment may clip or cap these values to be equivalent to the peaking display brightness $L_{PEAK}$. For example, the input luminance value $L_{MAX}$ of 10,000 cd/m$^2$ shown in row 604 exceeds the set value $L_{H(N)}$ of 4,000 shown in row 606, and the output luminance associated with the $L_{MAX}$ value of 10,000 cd/m$^2$ in row 604 is 600 cd/m$^2$, which is equivalent to $L_{PEAK}$. In such a way, the adaptive HDR tone mapping system in an embodiment may compress all input luminance values between $L_{TYP}$ of 400 cd/m$^2$ and $L_{MAX}$ of 10,000 cd/m$^2$ into output luminance values between $L_{TYP}$ of 400 cd/m$^2$ and $L_{PEAK}$ of 600 cd/m$^2$, while maintaining the relative contrast between the several regions of high luminance values from the HDR digital image.

Figure 7:
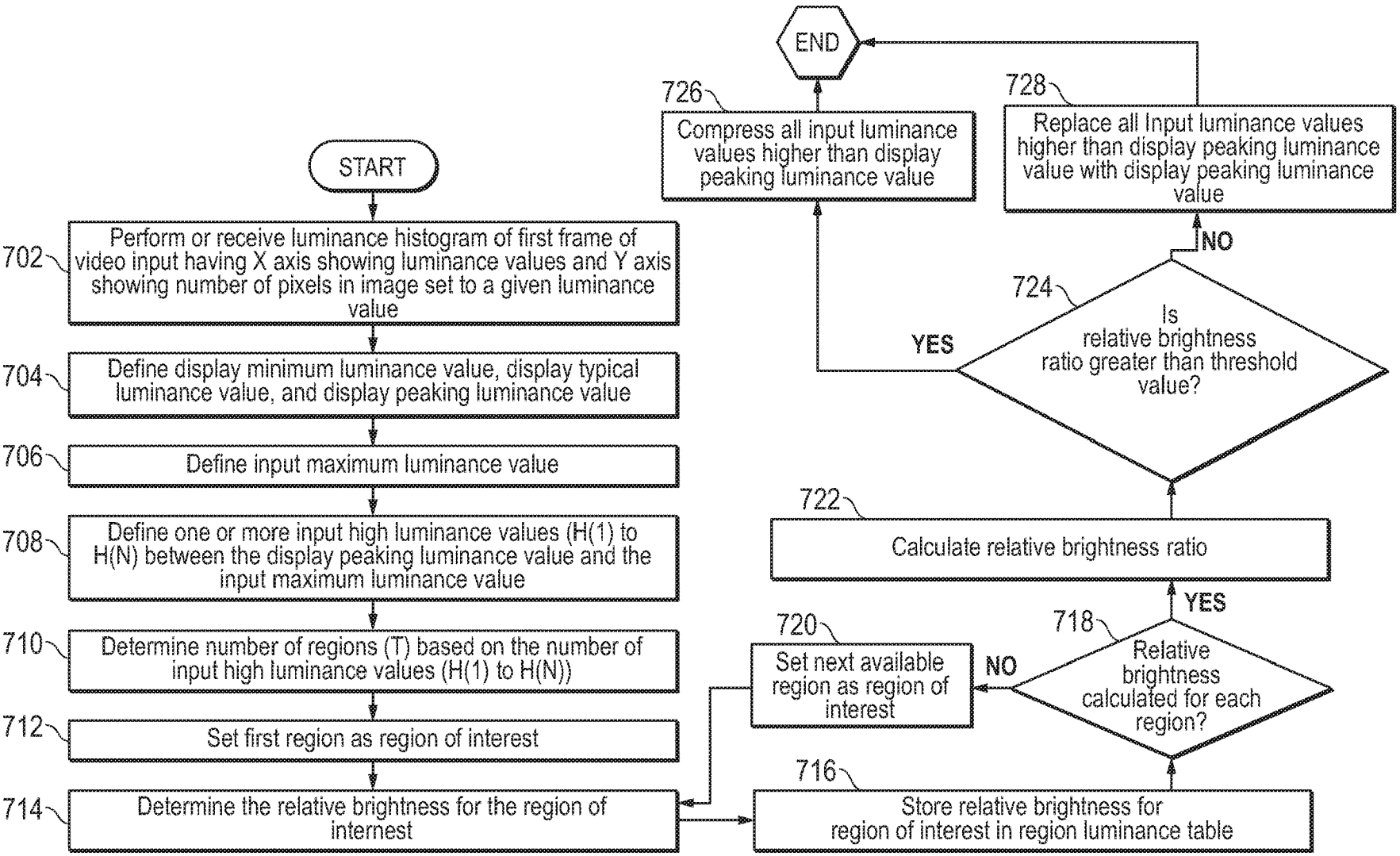
FIG. 7 is a flow diagram illustrating a method of determining a compression method according to an embodiment of the present disclosure.

FIG. 7 is a flow diagram illustrating a method of determining a compression method based on a sub-range compression factor for a plurality of high brightness sub-ranges according to an embodiment of the present disclosure. As described herein, the adaptive HDR tone mapping system in an embodiment may determine whether to compress an HDR digital image having luminance values exceeding the peaking display luminance by one of two methods: (1) capping all luminance values exceeding the peaking display luminance; or (2) by compressing all luminance values exceeding the peaking display luminance into the effective display luminance range using sub-range compression factors.

At block 702, in an embodiment, the adaptive HDR tone mapping system may perform or receive a luminance histogram of a first frame of video input having an X axis shown luminance values and a Y axis showing the number of pixels in the HDR image data set to a given luminance value. For example, upon receiving HDR digital image data in an embodiment, the adaptive HDR tone mapping system may generate a luminance histogram such as histogram 202, as shown in FIG. 2. The luminance histogram 202 in an embodiment may represent the distribution of luminance values across all pixels in a digital SDR video display based on the received HDR digital image data. The adaptive HDR tone mapping system in an embodiment may group all luminance (Y or Y') values in the received arrays of an HDR image into bins including a plurality of luminance values, and may further analyze the received arrays in order to determine how many separate pixels are associated with each bin. The adaptive HDR tone mapping system in an embodiment may repeat this method for each bin defined previously, as described directly above. The adaptive HDR tone mapping system may then generate a luminance histogram 202 plotting the frequency with which cells in the pixel array are associated with luminance values in each of the predefined luminance bins.

At block 704, the adaptive HDR tone mapping system in an embodiment may define a display minimum luminance value, a display typical luminance value, and a display peaking luminance value for the SDR video display device. For example, in an embodiment described with reference to FIG. 2, the adaptive HDR tone mapping system may further determine the typical display luminance $L_{TYP}$, and the peaking display luminance $L_{PEAK}$ by accessing those values as stored in memory, a graphics processing unit, or in firmware of the SDR video display. In an example embodiment described with reference to FIG. 2, $L_{TYP}$ may be equivalent to 400 cd/m$^2$, and $L_{PEAK}$ may be equivalent to 600 cd/m$^2$. In other embodiments, such as embodiments including an Intel SDR video display adhering to SDR standards, $L_{TYP}$ may be equivalent to 300 cd/m$^2$, and $L_{PEAK}$ may be equivalent to 400 cd/m$^2$.

At block 706 in an embodiment, the adaptive HDR tone mapping system in an embodiment may define an input maximum luminance value from the HDR digital image data. The adaptive HDR tone mapping system in an embodiment may determine this value by referencing the luminance histogram for the HDR digital image data. For example, in the embodiment of FIG. 2 at 214 in the histogram the $L_{MAX}$ value represents the input maximum luminance value for the HDR image data depicted there for an HDR image.

At block 708, the adaptive HDR tone mapping system may define one or more input high luminance values between the display peaking luminance and the input maximum luminance value. For example, in an embodiment described with reference to FIG. 2, the adaptive HDR tone mapping system may identify one or more regions of luminance values exceeding the peaking display luminance value $L_{PEAK}$ 206. These luminance values in an embodiment may represent luminance values the SDR video display is not capable of displaying, although these values are included in the HDR digital image data. As described herein, the adaptive HDR tone mapping system in an embodiment may determine which compression methods to employ based on the portion of the HDR digital image dedicated to displaying the luminance values outside the operable range of the SDR video display (e.g. above $L_{PEAK}$ 206) to the portion of the HDR digital image dedicated to displaying luminance values inside the operable range of the SDR video display (e.g. at or below $L_{PEAK}$ 206). For example, the adaptive HDR tone mapping system may designate a plurality of high-luminance values numbering 1 to N, including $L_{H(1)}$ 208, $L_{H(2)}$ 210, and $L_{H(N)}$ 212. The value N in such an embodiment may be three. The highest high-luminance value $L_{H(N)}$ 212 in some embodiments may be equivalent to the maximum luminance value $L_{MAX}$ 214 of the luminance histogram 202.

At block 710, in an embodiment, the adaptive HDR tone mapping system may determine a number of regions (T) based on the number of high input luminance values defined at block 708. The value T in an embodiment may be equivalent to (2*N)+3. For example, in an embodiment described with reference to FIG. 2, the adaptive HDR tone mapping system may designate three high-luminance values, such that N has a value of three, giving T a value of 9. The nine regions in such an embodiment may include but not be limited to region 1 describing $L_{MIN}$ to $L_{TYP}$ and region 5 describing $L_{MIN}$ to $L_{H(N)}$. The adaptive HDR tone mapping system may further separate the luminance values into other regions of interest not illustrated in FIG. 2. For example, in an embodiment described with reference to FIG. 3, the adaptive HDR tone mapping system may separate the luminance values into 9 or more regions, where region 1 describes $L_{MIN}$ to $L_{TYP}$, region 2 describes $L_{MIN}$ to $L_{PEAK}$, region 3 describes $L_{MIN}$ to $L_{H(1)}$, region 4 describes $L_{MIN}$ to $L_{H(2)}$, region 5 describes $L_{MIN}$ to $L_{H(N)}$, region 6 describes $L_{TYP}$ to $L_{PEAK}$, region 7 describes $L_{TYP}$ to $L_{H(1)}$, region 8 describes $L_{TYP}$ to $L_{H(2)}$, and region 9 describes $L_{TYP}$ to $L_{H(N)}$.

Other embodiments may include any number of high brightness sub-ranges exceeding $L_{PEAK}$ (e.g. as defined by an upper bound between $L_{H(1)}$ and $L_{H(N)}$). The number of high brightness sub-ranges may be preset prior to receipt of the HDR digital image, and may be equivalent to the number N of high-luminance key values. A greater number of regions in an embodiment may result in greater preservation of contrast between luminance values exceeding $L_{PEAK}$ if the adaptive HDR tone mapping system in an embodiment opts to compress these high-luminance values into the operable luminance range of the SDR video display. Similarly, a greater number of sub-ranges may also contribute to greater preservation of the HDR digital image data and less potential distortion as described in embodiments herein.

At block 712 in an embodiment, the adaptive HDR tone mapping system may set the first region as the region of interest for a comparison of the relative brightness in that region against the relative brightness associated with luminance values within the operating display luminance range. For example, in an embodiment described with reference to FIG. 3, the adaptive HDR tone mapping system may set region 1 as the first region of interest. The adaptive HDR tone mapping system may then analyze the luminance histogram in order to determine a relative brightness associated with region 1.

At block 714, the adaptive HDR tone mapping system in an embodiment may determine the relative brightness for the region of interest. The relative brightness $RB_{RN}$ for the luminance values within region N in embodiments may be equivalent to the total number of pixels associated with luminance values within that region according to the HDR digital image data, multiplied by the average of all luminance values within that region according to the HDR digital image data.

$$\text{Relative Brightness}_{RN}=P_{RN}\times L_\text{AVG}_{RN}$$

where P=number of pixels, and L_AVG=average luminance value (cd/m$^2$).

For example, in an embodiment, a measure of relative brightness for the luminance values at or below the typical luminance value of the display (e.g. within region 1) may provide an estimate of the portion of the HDR digital image that is dedicated to the display of luminance values inside the effective range of the SDR video.

At block 716, in an embodiment, the adaptive HDR tone mapping system may store the relative brightness for the region of interest in the region luminance table. For example, in embodiments described with reference to FIG. 3, in which the first region is set as the region of interest, the adaptive HDR tone mapping system may store the relative brightness $RB_{R1}$ of 320 for region 1 in column 314, row 310. As another example, in an embodiment described with reference to FIG. 3, in which the fifth region is set as the region of interest, the adaptive HDR tone mapping system may store the relative brightness $RB_{R5}$ of 350 for region 5 in column 322, row 310. In yet another example, in an embodiment described with reference to FIG. 5, in which the fifth region is set as the region of interest, the adaptive HDR tone mapping system may store the relative brightness $RB_{R5}$ of 600 for region 5 in column 522, row 510.

By comparing the values in FIGS. 3 and 5, it can be seen that the relative brightness in region 5 associated with FIG. 5 is greater than the relative brightness in region 5 associated with FIG. 3. This may be the case for example, if the majority of content for the HDR digital image analyzed with reference to FIG. 3 falls within the typical range of the SDR video display, and the majority of content for the HDR digital image analyzed with reference to FIG. 5 falls outside the typical range of the SDR video display, in the higher luminance values above $L_{PEAK}$ 206.

At block 718, the adaptive HDR tone mapping system in an embodiment may determine whether the relative brightness has been determined for each of the regions, from 1 to T, where T=(2*N)+3. The adaptive HDR tone mapping system may determine the relative brightness and store those average numbers in a region luminance table for every region from 1 to T. For example, in an embodiment described with reference to FIG. 3 where N=3, T may have a value of 9. The adaptive HDR tone mapping system in such an embodiment may determine the relative brightness for each of regions 1-9, and store these values in the region luminance table 302 in row 310. The adaptive HDR tone mapping system may determine at block 718 whether the relative brightness has been determined and stored for each region in order to ensure all cells in row 310 are filled. If the relative brightness for each region has not been determined, the method may proceed to block 720. If the relative brightness for each region has been determined, the method may proceed to block 722.

At block 720, if the relative brightness for each region has not been determined, the adaptive HDR tone mapping system in an embodiment may set the next available region as the region of interest. For example, in an embodiment in which the adaptive HDR tone mapping system set the first region as the region of interest at block 712 and the relative brightness has been determined only for region 1, the adaptive HDR tone mapping system may set the second region as the region of interest at block 720. The method may then proceed to block 714, and the adaptive HDR tone mapping system may determine and store the relative brightness for region 2.

At block 722, if the relative brightness for each region has been determined, the adaptive HDR tone mapping system in an embodiment may determine the relative brightness ratio. For example, in an embodiment described with reference to FIG. 3, if the relative brightness for regions 1-9 has been determined and stored in table 302, the adaptive HDR tone mapping system in an embodiment may determine relative brightness ratio between regions 1 and 5 which may be equivalent to:

$$\text{Relative Brightness Ratio}=\frac{RB_{R5}-RB_{R1}}{RB_{R1}}=\frac{(350-320)}{320}=0.09\text{ or }9\%$$

In another example embodiment described with reference to FIG. 5, in which the relative brightness for regions 1-9 has been determined and stored in table 502, the adaptive HDR tone mapping system may determine the relative brightness ratio between regions 1 and 5 which may be equivalent to:

$$\text{Relative Brightness Ratio}=\frac{RB_{R5}-RB_{R1}}{RB_{R1}}=\frac{(600-320)}{320}=0.88\text{ or }88\%$$

At block 724, the adaptive HDR tone mapping system may determine whether the relative brightness ratio determined at block 722 meets or exceeds a threshold value. The relative brightness ratio determined at block 722 may provide a rough estimate of the proportion of the HDR digital image data content that is associated with luminance ranges outside of the typical range of the SDR video display to the content that is associated with luminance ranges within the typical range of the SDR video display.

For example, in an embodiment described with reference to FIG. 5, if the relative brightness ratio determined at block 722 is equivalent to 88%, this may indicate a relatively high proportion of the HDR digital image content is associated with luminance ranges outside of the typical range of the SDR video display. If the preset threshold is 10%, for example, the relative brightness ratio equivalent to 88% may exceed this preset threshold value, and the method may then proceed to block 726. As another example, in an embodiment described with reference to FIG. 3, if the relative brightness ratio determined at block 722 is equivalent to only 9%, this may indicate a relatively low proportion of the HDR digital image content is associated with luminance ranges outside of the typical range of the SDR video display. If the preset threshold is 10%, for example, the relative brightness ratio equivalent to 9% may fall below this preset threshold value, and the method may then proceed to block 728.

In some embodiments, data for several HDR digital images may be analyzed prior to determining which compression method to employ. For example, each of the several HDR digital images may be associated with a separate region luminance table, and blocks 702 through 722 may be completed for each region luminance table (or each digital image). In such embodiments, the value determined at block 722 may further include averaging the determined relative brightness ratios in each of these tables with the average of the determined relative brightness ratios being compared against the preset threshold at block 724. If the relative brightness ratio determined at block 722 meets or exceeds the preset threshold value, the method may proceed to block 726. If the relative brightness ratio determined at block 722 does not meet the preset threshold value, the method may proceed to block 728.

At block 726, if the relative brightness ratio determined at block 722 meets or exceeds the preset threshold value, the adaptive HDR tone mapping system may compress all input luminance values in the HDR digital image higher than the peaking display luminance value $L_{PEAK}$ into the luminance range between $L_{TYP}$ and $L_{PEAK}$. A relative brightness ratio determined at block 722 that meets or exceeds the preset threshold value may indicate the majority of the content of the HDR digital image is intended to be displayed outside the operable range of the SDR video display. In such embodiments, the adaptive HDR tone mapping system may opt to compress the luminance values outside the operable range of the SDR video display into the operable range of the SDR video display in order to preserve the relative contrast between the luminance values above the display peaking luminance within the HDR digital image. Compression into the operable range of the SDR video display device may be linear or non-linear according to various embodiments herein.

At block 728, if the relative brightness ratio determined at block 722 does not meet the preset threshold value, the adaptive HDR tone mapping system may clip or cut all input luminance values in the HDR digital image data higher than the peaking display luminance value $L_{PEAK}$ to compress them to map onto $L_{PEAK}$ values. A relative brightness ratio determined at block 722 that does not meet the preset threshold value may indicate the majority of the content of the HDR digital image data is intended to be displayed within the operable range of the SDR video display. In such embodiments, the adaptive HDR tone mapping system may opt to cut or clip the luminance values outside the operable range of the SDR video display, causing pixels associated with input luminance values above $L_{PEAK}$ to display at the output luminance value of $L_{PEAK}$.

For example, in an embodiment described with reference to FIG. 4, in which the relative brightness ratio does not meet the preset threshold value, the adaptive HDR tone mapping system may employ a compression method involving cropping out or capping all luminance values exceeding the peaking display luminance $L_{PEAK}$. As shown in column 424 of table 402 for example, the adaptive HDR tone mapping system may compress the input luminance values of column 418 into the effective display range between $L_{TYP}$ and $L_{PEAK}$ by capping the input luminance values exceeding the peaking display luminance $L_{PEAK}$ of 600 cd/m$^2$ at the peaking display luminance of 600 cd/m$^2$. The method may then end.

In other embodiments, the determination of which compression method to employ may depend upon a currently operating application, or a currently employed picture setting. The graphics processing unit in an embodiment may operate to store one or more profiles defining picture settings of the SDR video display. For example, profiles may include a gaming, movie, or vivid picture setting, wherein each picture setting is associated with a tone mapping method because certain levels of distortion may or may not be tolerated or noticeable for particular applications. The adaptive HDR tone mapping system in an embodiment may access these one or more profiles, and determine the optimal compression method based on the profile currently in use. For example, the adaptive HDR tone mapping system may compress the luminance values higher than the display peaking luminance value into the operable luminance range of the SDR video display (as described with reference to block 726 and below with respect to FIG. 8) if the vivid picture setting is currently in use. As another example, the adaptive HDR tone mapping system may compress the luminance values higher than the display peaking luminance value into the operable luminance range of the SDR video display if a gaming application is identified as currently in use.

Figure 8:
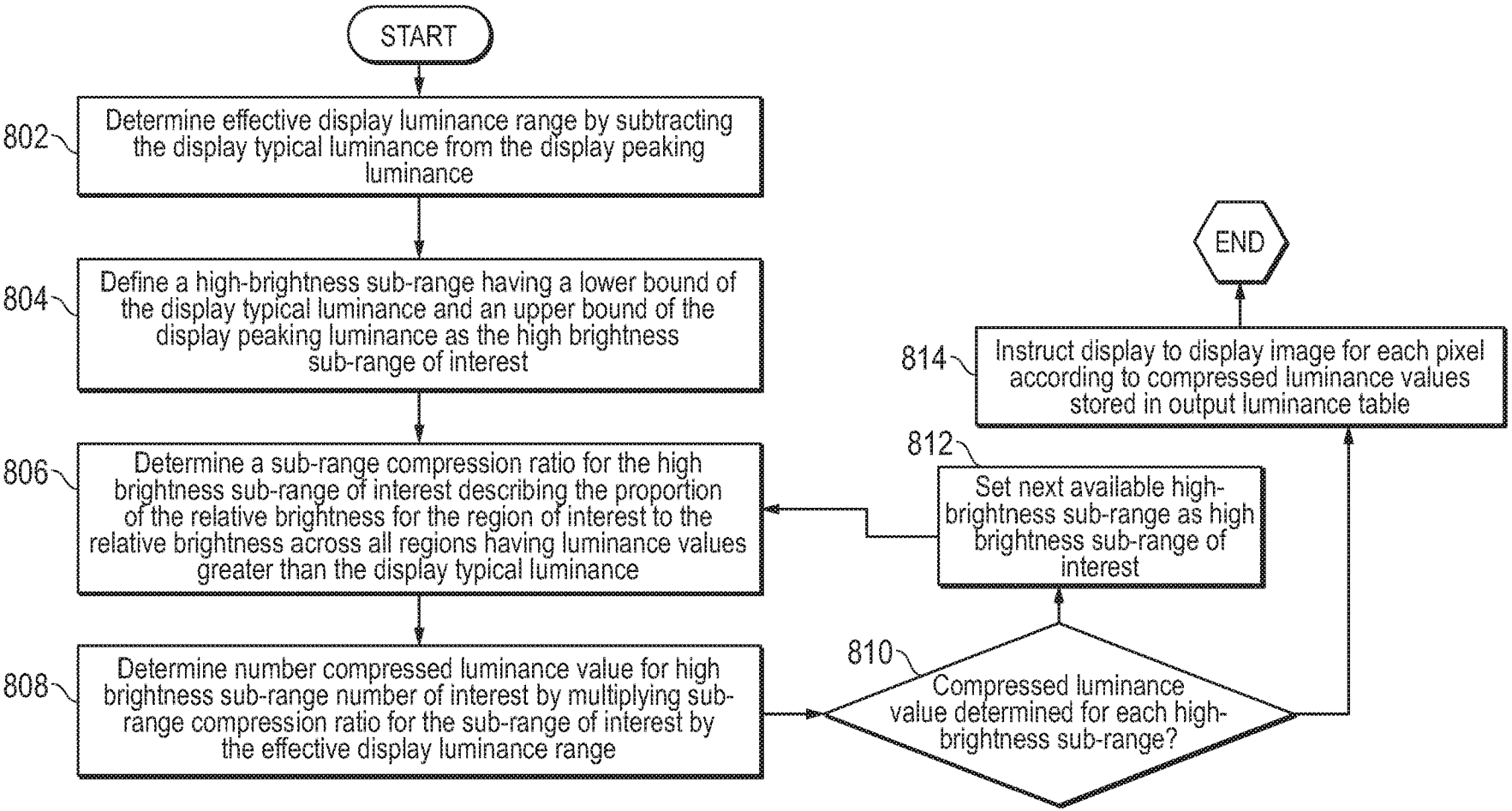
FIG. 8 is a flow diagram illustrating a method of compressing high luminance values of an HDR digital image into an operable luminance range of an SDR video display or other lower dynamic range display according to an embodiment of the present disclosure.

FIG. 8 is a flow diagram illustrating a method of compressing high luminance values of data for an HDR digital image exceeding the peaking display luminance into an operable luminance range between the typical and peaking display luminance values of an SDR video display according to an embodiment of the present disclosure. At block 802, the adaptive HDR tone mapping system in an embodiment may determine an effective display luminance range by subtracting the display typical luminance from the display peaking luminance. For example, in an embodiment described with reference to FIG. 6, the second column 620 of table 602 may define the effective display range between $L_{TYP}$ and $L_{PEAK}$ in cd/m$^2$ as between 600 cd/m$^2$ and 400 cd/m$^2$, or having a range magnitude of 200 cd/m$^2$.

At block 804, the adaptive HDR tone mapping system in an embodiment may define the range of luminance values between $L_{TYP}$ and $L_{PEAK}$ as a high-brightness sub-range of interest. The HDR tone mapping system in an embodiment may define a number of high brightness sub-ranges equivalent to the number of key high luminance values (N). For example, in an embodiment described with reference to FIG. 5, in order to determine the factor by which each luminance value should be compressed according to the non-linear approach, the HDR tone mapping system in an embodiment may identify the one or more key luminance values between $L_{PEAK}$ and $L_{MAX}$. As shown in FIG. 5, the HDR tone mapping system has defined high brightness values $L_{H(1)}$ of 1,000 cd/m$^2$, $L_{H(2)}$ of 2,000 cd/m$^2$, and $L_{H(N)}$ of 4,000 cd/m$^2$, and each of these high brightness values, as well as the peaking display brightness (e.g. $L_{PEAK}$ to $L_{H(N)}$) in an embodiment may define the boundaries of one or more high brightness value sub-ranges. For example, $L_{H(1)}$ may define an upper limit to a first high brightness sub-range (e.g. region 6) describing all luminance values between $L_{PEAK}$ and $L_{H(1)}$. The relative brightness associated of this first high brightness sub-range may be shown in FIG. 5 and column 524, row 510 as 500 cd/m$^2$. The relative brightness of the region exceeding the typical display brightness $L_{TYP}$ in an embodiment may be equivalent to the average number of pixels in region 9 spanning from $L_{TYP}$ to $L_{H(N)}$ given by the value 2,000 cd/m$^2$ at column 530, row 510, minus the typical display luminance given by 400 cd/m$^2$.

As another example, $L_{H(1)}$ may define an upper limit to a second high brightness sub-range describing all luminance values between $L_{PEAK}$ and $L_{H(1)}$. The relative brightness of this second high brightness sub-range may be equivalent to the relative brightness of region 7 spanning from $L_{TYP}$ to $L_{H(1)}$ given by the value 800 cd/m$^2$ at column 526, row 510, minus the relative brightness of region 6 spanning from $L_{TYP}$ to $L_{PEAK}$ given by the value 500 cd/m$^2$ at column 524, row 510. As another example, $L_{H(2)}$ may define an upper limit to a third high brightness sub-range describing all luminance values between $L_{H(1)}$ and $L_{H(2)}$. The relative brightness of this third high brightness sub-range may be equivalent to the relative brightness of region 8 spanning from $L_{TYP}$ to $L_{H(2)}$ given by the value 1,500 cd/m$^2$ at column 528, row 510, minus the relative brightness of region 7 spanning from $L_{TYP}$ to $L_{H(1)}$ given by the value 800 cd/m$^2$ at column 526, row 510. As yet another example, $L_{H(N)}$ may define an upper limit to a fourth high brightness sub-range describing all luminance values between $L_{H(2)}$ and $L_{H(N)}$. The relative brightness of this fourth high brightness sub-range may be equivalent to the relative brightness of region 9 spanning from $L_{TYP}$ to $L_{H(N)}$ given by the value 2,000 cd/m$^2$ at column 530, row 510, minus the relative brightness of region 8 spanning from $L_{TYP}$ to $L_{H(2)}$ given by the value 1,500 cd/m$^2$ at column 528, row 510.

At block 806, in an embodiment, the adaptive HDR tone mapping system may determine a sub-range compression factor for the high brightness sub-range of interest describing the proportion of the relative brightness of the high brightness sub-range of interest to the relative brightness of all regions having luminance values greater than the display typical luminance. In an embodiment described with reference to FIG. 5, the adaptive HDR tone mapping system in an embodiment may determine the sub-range compression factor for a first high brightness sub-range having an upper bound of the peaking display luminance value $L_{PEAK}$ using the formula:

$$\text{Sub-range Compression } Factor_M = \frac{RB_{R(S)}}{RB_{R(T)} - L_{TYP}}$$

where M=1, T=maximum number of key luminance values=(2*N)+3, and S=N+M+2. For example, as shown in column 524 at row 512, the adaptive HDR tone mapping system in an embodiment may determine the sub-range compression ratio for the first high brightness sub-range where M=1, N=3, T=(2*3)+3=9, and S=N+M+2=6 using the formula $$\text{Sub-range Compression } Factor_1 = \frac{RB_{R6}}{RB_{R9} - L_{TYP}} = \frac{500}{2{,}000 - 400} = 0.0625$$

At block 808, the adaptive HDR tone mapping system in an embodiment may determine the compressed output luminance value for the high brightness sub-range of interest by multiplying the sub-range compression factor for the high brightness sub-range of interest determined in block 806 by the effective display luminance range determined at block 802. For example, in an embodiment in which the high brightness sub-range of interest is sub-range 1, the adaptive HDR tone mapping system may determine a compressed output luminance value for sub-range 1 by multiplying the sub-range compression factor of 0.0625 by the effective display luminance range of 200 cd/m$^2$, as shown in FIG. 6 at row 612 of table 602. This may result in compressing the input luminance value of 600 cd/m$^2$ shown in column 618 to an output compressed luminance value of 412.5 cd/m$^2$ as shown in column 624 of table 602. The output compressed luminance value for the high brightness sub-range of interest may be stored in an output luminance table such as, for example, output luminance table 602 of FIG. 6.

At block 810, the adaptive HDR tone mapping system in an embodiment may determine whether the compressed luminance value has been determined for each high brightness sub-range. The adaptive HDR tone mapping system in an embodiment may need to determine the compressed luminance value of each high brightness sub-range in order to determine a relative contrast between luminance values in each region. By doing so, the adaptive HDR tone mapping system may simulate the same contrast between luminance values after compressing the luminance values exceeding the display peaking luminance value into the luminance range between $L_{TYP}$ and $L_{PEAK}$. For example, the adaptive HDR tone mapping system in an embodiment described with reference to FIG. 6 may determine whether the compressed luminance value has been determined for sub-ranges 1-4. If the adaptive HDR tone mapping system determines the compressed luminance value has not been determined for each high brightness sub-range, the method may proceed to block 812. If the adaptive HDR tone mapping system determines the compressed luminance value has been determined for each high brightness sub-range, the method may proceed to block 814.

At block 812, if the adaptive HDR tone mapping system in an embodiment determines the compressed luminance value has not been determined for each high brightness sub-range, the adaptive HDR tone mapping system may set the next available region as the high brightness sub-range of interest. The adaptive HDR tone mapping system in an embodiment may determine the sub-range compression factors for regions numbered M, where M is greater than one, T=maximum number of key luminance values=(2*N)+3, and S=N+M+2, using the formula:

$$\text{Sub-range Compression } Factor_M = \frac{RB_{R(S)} - RB_{R(S-1)}}{RB_{R(T)} - L_{TYP}}$$

For example, in an embodiment in which the adaptive HDR tone mapping system set the second sub-range as the high brightness sub-range of interest at block 804 and the compressed output luminance value has been determined only for sub-range one, the adaptive HDR tone mapping system may set the sub-range two as the high brightness sub-range of interest at block 812. The method may then proceed to block 806, and the adaptive HDR tone mapping system may determine and store the compressed output luminance value for sub-range two in an output luminance table. For example, for a second high-brightness sub-range having luminance values between $L_{PEAK}$ and $L_{H(1)}$ in an embodiment, M may have a value of 2. If N=3, and T=(2*N)+3, T may have a value of 9, as shown in FIG. 5. Further, if S=N+M+2, S may have a value of 7. As shown in column 526 at row 512, the sub-range compression factor for high-brightness sub-range 2 in such an embodiment may be determined as:

$$\text{Sub-Range Compression } Factor_2 = \frac{RB_{R7} - RB_{R6}}{RB_{R9} - L_{TYP}} = \frac{800 - 500}{2{,}000 - 400} = 0.1875$$

As another example, in an embodiment in which the adaptive HDR tone mapping system set the third sub-range as the high brightness sub-range of interest at block 804 and the compressed output luminance value has been determined only for sub-ranges one and two, the adaptive HDR tone mapping system may set the sub-range three as the high brightness sub-range of interest at block 812. The method may then proceed to block 806, and the adaptive HDR tone mapping system may determine and store the compressed output luminance value for sub-range three in an output luminance table. For example, for a third high-brightness sub-range having luminance values between $L_{H(1)}$ and $L_{H(2)}$ in an embodiment, M may have a value of 3. If N=3, and T=(2*N)+3, T may have a value of 9, as shown in FIG. 5. Further, if S=N+M+2, S may have a value of 8. As shown in column 528 at row 512, the sub-range compression factor for high-brightness sub-range 3 in such an embodiment may be determined as:

$$\text{Sub-Range Compression } Factor_3 = \frac{RB_{R8} - RB_{R7}}{RB_{R9} - L_{TYP}} = \frac{1{,}500 - 800}{2{,}000 - 400} = 0.4375$$

As yet another example, in an embodiment in which the adaptive HDR tone mapping system set the fourth sub-range as the high brightness sub-range of interest at block 804 and the compressed output luminance value has been determined only for sub-ranges one through three, the adaptive HDR tone mapping system may set the sub-range four as the high brightness sub-range of interest at block 812. The method may then proceed to block 806, and the adaptive HDR tone mapping system may determine and store the compressed output luminance value for sub-range four in an output luminance table. For example, for a fourth high-brightness sub-range having luminance values between $L_{H(2)}$ and $L_{H(N)}$ in an embodiment, M may have a value of 4. If N=3, and T=(2*N)+3, T may have a value of 9, as shown in FIG. 5. Further, if S=N+M+2, S may have a value of 9. As shown in column 530 at row 512, the sub-range compression factor for high-brightness sub-range 4 in such an embodiment may be determined as:

$$\text{Sub-Range Compression } Factor_4 = \frac{RB_{R9} - RB_{R8}}{RB_{R9} - L_{TYP}} = \frac{2{,}000 - 1{,}500}{2{,}000 - 400} = 0.3125$$

At block 814, if the adaptive HDR tone mapping system in an embodiment determines the compressed luminance value has been determined for each high brightness sub-range, the adaptive HDR tone mapping system may instruct the display to display the image for each pixel according to the compressed luminance values stored in an output luminance table. For example, in an embodiment described with respect to FIG. 6, the adaptive HDR tone mapping system in an embodiment may instruct the SDR video display to replace the luminance values in the HDR image array associated with an input luminance value of 10,000 cd/m$^2$ with a compressed output luminance value of 600 cd/m$^2$, to replace the luminance values in the HDR image array associated with an input luminance value of 10,000 cd/m$^2$ with a compressed output luminance value of 600 cd/m$^2$ as shown in row 604 of table 602, to replace the luminance values in the HDR image array associated with an input luminance value of 4,000 cd/m$^2$ with a compressed output luminance value of 600 cd/m$^2$ as shown in row 606, to replace the luminance values in the HDR image array associated with an input luminance value of 2,000 cd/m$^2$ with a compressed output luminance value of 537.5 cd/m$^2$ shown in row 608, to replace the luminance values in the HDR image array associated with an input luminance value of 1,000 cd/m$^2$ with a compressed output luminance value of 450 cd/m$^2$ as shown in row 610, and to replace the luminance values in the HDR image array associated with an input luminance value of 600 cd/m$^2$ with a compressed output luminance value of 412.5 cd/m$^2$ as shown in row 612. The method may then end.

The blocks of flow diagrams 7-8 discussed above need not be performed in any given or specified order. It is contemplated that additional blocks, steps, or functions may be added, some blocks, steps or functions may not be performed, blocks, steps, or functions may occur contemporaneously, and blocks, steps or functions from one flow diagram may be performed within another flow diagram.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An information handling system operating an adaptive high dynamic range (HDR) tone mapping system comprising:

a display screen including a plurality of pixels operating at a lower dynamic range of brightness values wherein a peaking display brightness value is below a maximum brightness value within data for an HDR digital image;

a graphics processor operably connected to the plurality of pixels executing code instructions of the adaptive HDR tone mapping system to receive data for an HDR digital image and prepare the HDR digital image for display at the lower dynamic range of brightness values;

the graphics processor to determine a relative brightness ratio comparing a number of a first plurality of pixels in the data for the HDR digital image to display at a brightness level below a typical display brightness of the display screen to a number of a second plurality of pixels in the data for the HDR digital image to display at or above the typical display brightness of the display screen;

the graphics processor to generate a first adaptive tone map to modify the data of the HDR digital image if the relative brightness ratio does not meet or exceed a preset relative brightness threshold such that the first plurality of pixels will display in the lower dynamic range of brightness values and the second plurality of pixels are mapped to a clipped brightness level equivalent to the peaking display brightness level of the display screen; and the display screen displaying the first plurality of pixels and the second plurality of pixels of the HDR digital image within the lower dynamic range of brightness values, according to the first adaptive tone map modification.

2. The information handling system of claim 1 further comprising:

the graphics processor to generate a second adaptive tone map to modify the data of the HDR digital image if the relative brightness ratio meets or exceeds the preset relative brightness threshold such that the first plurality of pixels and the second plurality of pixels are compressed to fit within the lower dynamic range of brightness values for display at or below the peaking display brightness level value of the display screen.

3. The information handling system of claim 2 further comprising:

the graphics processor to identify a range of high brightness values at or above the peaking display brightness value of the display screen in the data for the HDR digital image and partition the range of high brightness values into a plurality of high brightness value subranges;

the graphics processor to determine a number of pixels with brightness values within a first of the high brightness value subranges;

the graphics processor to determine a subrange compression factor between the number of the plurality of pixels within the first of the high brightness value subranges and the number of pixels exceeding the typical display brightness value in the data for the HDR image; and the graphics processor to generate the second adaptive tone map to apply a degree of compression for the first of the high brightness value subranges in accordance with the corresponding subrange compression factor.

4. The information handling system of claim 1, wherein lower dynamic range of brightness values is a standard dynamic range (SDR) of brightness values.

5. The information handling system of claim 1, wherein the relative brightness ratio is determined using a histogram analysis of data for the HDR digital image.

6. The information handling system of claim 1, wherein the preset relative brightness threshold is equivalent to 10%.

7. The information handling system of claim 1, wherein the typical display brightness is 400 candelas per meter squared.

8. A method for adaptively generating a high dynamic range (HDR) tone map comprising:

receiving data for an HDR digital image and preparing via a graphics processor the HDR digital image for display at a lower dynamic range of brightness values on a display device having a lower operable dynamic range than the HDR digital image data;

determining via the graphics processor a relative brightness ratio comparing a number of a first plurality of pixels in the data for the HDR digital image to display at a brightness level below a typical display brightness of the display screen to a number of a second plurality of pixels in the data for the HDR digital image to display at or above the typical display brightness of the display screen;

generating via the graphics processor a first adaptive tone map to modify the data of the HDR digital image if the relative brightness ratio does not meet or exceed a preset relative brightness threshold such that the first plurality of pixels will display in the lower dynamic range of brightness values and the second plurality of pixels are mapped to a clipped brightness level equivalent to a peaking display brightness level of the display screen; and displaying via the display screen the first plurality of pixels and the second plurality of pixels of the HDR digital image within the lower dynamic range of brightness values, according to the first adaptive tone map modification of the HDR digital image data.

9. The method of claim 8 further comprising:

generating via the graphics processor a second adaptive tone map to modify the data of the HDR digital image if the relative brightness ratio meets or exceeds the preset relative brightness threshold such that the first plurality of pixels and the second plurality of pixels are compressed to fit within the lower dynamic range of brightness values for display at or below the peaking display brightness level value of the display screen.

10. The method of claim 8 further comprising:

identifying, via the graphics processor, a range of high brightness values at or above the peaking display brightness value of the display screen in the data for the HDR digital image and partitioning the range of high brightness values into a plurality of high brightness value subranges if the relative brightness ratio meets or exceeds the preset relative brightness threshold;

determining via the graphics processor a number of pixels with brightness values within a first of the high brightness value subranges;

determining via the graphics processor a subrange compression factor between the number of the plurality of pixels within the first of the high brightness value subranges and the number of pixels exceeding the typical display brightness value in the data for the HDR image; and generating via the graphics processor the second adaptive tone map to apply a degree of compression for the first of the high brightness value subranges in accordance with the corresponding subrange compression factor.

11. The method of claim 8, wherein lower dynamic range of brightness values is a standard dynamic range (SDR) of brightness values.

12. The method of claim 8, wherein the relative brightness ratio is determined using a histogram analysis of the HDR digital image.

13. The method of claim 8, wherein the preset relative brightness threshold is equivalent to 80%.

14. The method of claim 8, wherein the typical display brightness is 400 candelas per meter squared.

15. An information handling system operating an adaptive high dynamic range (HDR) tone mapping system comprising:

a display screen including a plurality of pixels operating at a lower dynamic range of brightness values wherein a peaking display brightness value is below a maximum brightness value within data for an HDR digital image;

a graphics processor operably connected to the plurality of pixels executing code instructions of the adaptive HDR tone mapping system to receive data for an HDR digital image and prepare the HDR digital image for display at the lower dynamic range of brightness values;

the graphics processor to determine a relative brightness ratio comparing a number of a first plurality of pixels in the data for the HDR digital image to display at a brightness level below a typical display brightness of the display screen to a number of a second plurality of pixels in the data for the HDR digital image to display at or above the typical display brightness of the display screen, the graphics processor to generate a first adaptive tone map to modify the data of the HDR digital image if the relative brightness ratio does not meet or exceed a preset relative brightness threshold such that the first plurality of pixels will display in the lower dynamic range of brightness values and the second plurality of pixels are mapped to a clipped brightness level equivalent to the peaking display brightness level of the display screen;

the graphics processor to generate a second adaptive tone map to modify the data of the HDR digital image if the relative brightness ratio meets or exceeds the preset relative brightness threshold such that the first plurality of pixels and the second plurality of pixels are compressed to fit within the lower dynamic range of brightness values for display at or below the peaking display brightness level value of the display screen; and the display screen displaying the first plurality of pixels and the second plurality of pixels of the HDR digital image within the lower dynamic range of brightness values, according to the generation of the first adaptive tone map or the second adaptive tone map.

16. The information handling system of claim 15 further comprising:

the graphics processor to identify a range of high brightness values at or above a peaking display brightness value of the display screen in the data for the HDR digital image and partition the range of high brightness values into a plurality of high brightness value subranges when the second adaptive tone map is generated;

the graphics processor to determine a number of pixels with brightness values within a first of the high brightness value subranges;

the graphics processor to determine a subrange compression factor between the number of the plurality of pixels within the first of the high brightness value subranges and the number of pixels exceeding the typical display brightness value in the data for the HDR image; and the graphics processor to generate the second adaptive tone map to apply a degree of compression for the first of the high brightness value subranges in accordance with the corresponding subrange compression factor.

17. The information handling system of claim 15, wherein the typical display brightness of the display screen is 300 candelas per meter squared.

18. The information handling system of claim 15, wherein the peaking display brightness of the display screen is 400 candelas per meter squared.

19. The information handling system of claim 15, wherein lower dynamic range of brightness values is a standard dynamic range (SDR) of brightness values.

20. The information handling system of claim 15, wherein the peaking display brightness of the display screen is 600 candelas per meter squared.

* * * * *